US011255535B1

(12) United States Patent
Eckert et al.

(10) Patent No.: US 11,255,535 B1
(45) Date of Patent: Feb. 22, 2022

(54) ILLUMINATED CONTROL KNOB

(71) Applicant: Sub-Zero Group, Inc., Madison, WI (US)

(72) Inventors: Mark R. Eckert, Verona, WI (US); Alexander R. Krahn, Sun Prairie, WI (US); Bronson Blum, Cottage Grove, WI (US)

(73) Assignee: Sub-Zero Group, Inc., Madison, WI (US)

( * ) Notice: Subject to any disclaimer, the term of this patent is extended or adjusted under 35 U.S.C. 154(b) by 0 days.

(21) Appl. No.: 17/146,627

(22) Filed: Jan. 12, 2021

(51) Int. Cl.

| | |
|---|---|
| ***F21V 33/00*** | (2006.01) |
| ***F24C 7/08*** | (2006.01) |
| ***F24C 3/12*** | (2006.01) |
| ***G05G 1/10*** | (2006.01) |
| *F21W 131/307* | (2006.01) |
| *F21Y 115/10* | (2016.01) |

(52) U.S. Cl.
CPC ..... *F21V 33/0044* (2013.01); *F24C 3/122* (2013.01); *F24C 7/082* (2013.01); *G05G 1/105* (2013.01); *F21W 2131/307* (2013.01); *F21Y 2115/10* (2016.08)

(58) Field of Classification Search
CPC ..... F21V 33/0044; F21V 3/122; F24C 7/082; G05B 1/105; H01H 2219/062; H01H 2219/0622; H01H 2219/044; H01H 19/025; H01H 3/08
See application file for complete search history.

(56) References Cited

U.S. PATENT DOCUMENTS

| | | | |
|---|---|---|---|
| 2,682,859 | A | 7/1954 | Jensen et al. |
| 2,699,141 | A | 1/1955 | Gaguski |
| 2,998,733 | A | 9/1961 | Thompson |
| D194,137 | S | 11/1962 | Jenn |
| D266,348 | S | 9/1982 | Piesco |

(Continued)

FOREIGN PATENT DOCUMENTS

| | | |
|---|---|---|
| EP | 2659190 | 9/2014 |

OTHER PUBLICATIONS

Design examination report No. 1 issued in Australian Design Application 202016095 dated Jun. 29, 2021.

(Continued)

*Primary Examiner* — Rajarshi Chakraborty
*Assistant Examiner* — Michael Chiang
(74) *Attorney, Agent, or Firm* — Bell & Manning, LLC

(57) ABSTRACT

A knob assembly includes a knob, a light assembly, a light socket, and a receptacle. The light assembly includes a light diffuser, a light source, and a light connector prong. Light from the light source is transmitted through the light diffuser. The light connector prong is electrically connected to the light source to provide power to the light source when the knob is rotated. The light socket includes a socket housing, a light connector aperture wall, an electrical connector aperture wall, and an internal conductor. The light connector prong is mounted within the light connector aperture wall. A power connector prong connectable to a power source is mounted within the electrical connector aperture wall. The connector housing of the receptacle is configured to house the light socket. The light connector prong is inserted into the light connector aperture wall through a first wall of the device.

20 Claims, 28 Drawing Sheets

(56) References Cited

U.S. PATENT DOCUMENTS

| | | | |
|---|---|---|---|
| D316,293 | S | 4/1991 | Ragonot |
| D324,807 | S | 3/1992 | Reid et al. |
| D369,940 | S | 5/1996 | Wilsdorf |
| D400,778 | S | 11/1998 | Holbrook |
| 5,936,613 | A | 8/1999 | Jaeger et al. |
| D419,218 | S | 1/2000 | Mullenmeister |
| 6,079,401 | A | 6/2000 | Alvord et al. |
| D493,090 | S | 7/2004 | Chen et al. |
| D498,657 | S | 11/2004 | Milrud et al. |
| D509,095 | S | 9/2005 | Grutzke et al. |
| D509,987 | S | 9/2005 | Vetter |
| D511,290 | S | 11/2005 | Coudurier |
| D525,517 | S | 7/2006 | Baldwin |
| D525,518 | S | 7/2006 | Baldwin |
| D534,628 | S | 1/2007 | Chisenhall |
| 7,171,727 | B2 | 2/2007 | Wylie et al. |
| 7,251,861 | B2 | 8/2007 | Suzuki |
| 7,259,908 | B2 | 8/2007 | Wagener et al. |
| D568,715 | S | 5/2008 | Gustafson et al. |
| 7,381,128 | B2 | 6/2008 | Ogawa et al. |
| D578,890 | S | 10/2008 | Swanson et al. |
| 7,462,795 | B2 | 12/2008 | Montalvo |
| D597,632 | S | 8/2009 | Obara et al. |
| D631,726 | S | 2/2011 | Sanchez |
| D642,042 | S | 7/2011 | Kim |
| D644,912 | S | 9/2011 | Benold |
| D645,702 | S | 9/2011 | Baacke et al. |
| D649,004 | S | 11/2011 | Sanchez |
| 8,430,460 | B2 | 4/2013 | Erro et al. |
| D696,068 | S | 12/2013 | Baacke |
| D697,359 | S | 1/2014 | Meda et al. |
| 8,662,102 | B2 | 3/2014 | Shaffer et al. |
| D704,028 | S | 5/2014 | Meda et al. |
| D724,381 | S | 3/2015 | Pionek et al. |
| D724,382 | S | 3/2015 | Pionek et al. |
| D724,888 | S | 3/2015 | Lee et al. |
| 8,979,289 | B2 | 3/2015 | Camli et al. |
| 9,146,033 | B2 | 9/2015 | Cadima et al. |
| D741,454 | S | 10/2015 | Freier et al. |
| D752,385 | S | 3/2016 | Pionek et al. |
| D752,386 | S | 3/2016 | Pionek et al. |
| D764,028 | S | 8/2016 | Schoenherr et al. |
| D779,262 | S | 2/2017 | Kim et al. |
| D781,126 | S | 3/2017 | Pionek et al. |
| D806,512 | S | 1/2018 | Chow et al. |
| 2012/0012721 | A1* | 1/2012 | Baier ..... H01H 19/025 248/224.7 |
| 2014/0047943 | A1 | 2/2014 | Camli et al. |
| 2017/0227231 | A1* | 8/2017 | Pionek ..... F24C 3/124 |
| 2018/0045419 | A1* | 2/2018 | Kim ..... F24C 7/082 |
| 2018/0232001 | A1* | 8/2018 | Gur ..... H01H 19/14 |
| 2018/0245795 | A1* | 8/2018 | Serabatir ..... F24C 7/082 |
| 2021/0111657 | A1* | 4/2021 | Altonen ..... G01R 19/16538 |

OTHER PUBLICATIONS

SubZero Wolf Australia subzerowolfaust Instagram photos and videos' which was published on the website https://www.instagram.com/p/B-nuUODFF8X/ on Apr. 6, 2020.

How a Wolf 48 Duel Fuel Range is made BrandmadeTV YouTube' which was published on the website https://www.youtube.com/watch?v=X8GD0x_rObo on Dec. 9, 2015.

4 Facebook' which was published on the website https://www.facebook.com/HandmadeKitchenCo/photos/p.2107277619393842/2107277619393842/?opaqueCursor=AbrM3y4QSkE-InfP2C6ddnBXnEm-scTg1NgDB_ITSRMEU_x6i1YO08IQRJ5PR5JG96GYjT-5IJ4iGPWuOHsUFBZyi2PzYzpEG . . . on Feb. 26, 2019.

Wolf Range Review the Luxury Standard for Your Kitchen YouTube' which was published on the website https://www.youtube.com/watch?v=2EBoKqnjqKo on Sep. 22, 2018.

Wolfkitchen hashtag on Instagram Photos and Videos' which was published on the website https://www.instagram.com/p/B6uU2nVqyM2/ on Dec. 31, 2019.

4 Facebook' which was published on the website https://www.facebook.com/Viking/photos/10156231386187170 on May 5, 2018.

* cited by examiner

ILLUMINATED CONTROL KNOB

BACKGROUND

Control knobs are mounted to various devices to control operation of the device. Illumination of the control knob can be used to indicate whether the device is in use.

SUMMARY

In an example embodiment, a knob assembly is provided. The knob assembly may include, but is not limited to, a knob, a light assembly, a light socket, and a receptacle. The knob is configured to mount to a knob control rod configured to rotate with the knob when the knob is rotated to control operation of a device. The light assembly is mounted to the knob. The light assembly may include, but is not limited to, a light housing, a light diffuser, a light source, and a light connector prong. The light housing may include a first aperture wall defining a first aperture through which the knob control rod extends when the light assembly is mounted between the knob and the device. The light diffuser is mounted to the light housing. The light source is mounted to the light housing. Light from the light source is transmitted through the light diffuser when the knob is rotated to control operation of the device. The light connector prong is mounted to the light housing and electrically connected to the light source to provide power to the light source when the knob is rotated. The light socket may include, but is not limited to, a socket housing, a light connector aperture wall, an electrical connector aperture wall, and an internal conductor. The light connector aperture wall is formed in a first wall of the socket housing. The light connector prong is mounted within the light connector aperture wall when the light assembly is mounted to the light socket. The electrical connector aperture wall is formed in a second wall of the socket housing. A power connector prong connectable to a power source is mounted within the electrical connector aperture wall when the light socket is electrically connected to the device. The internal conductor is mounted within the socket housing and configured to electrically connect the light connector prong to the power connector prong. The receptacle is mounted between the light assembly and the device. The receptacle may include, but is not limited to, a receptacle base and a connector housing. The receptacle base may include a second aperture wall defining a second aperture through which the knob control rod extends when the receptacle is mounted to the device. The connector housing is mounted to the receptacle base and configured to house the light socket. The receptacle base is configured to mount adjacent a first face of a first wall of the device when the knob assembly is mounted to the device. The light diffuser is configured to mount adjacent a second face of the first wall of the device when the knob assembly is mounted to the device. The second face is on an opposite side of the first wall relative to the first face. The light connector prong is inserted into the light connector aperture wall through the first wall when the knob assembly is mounted to the device.

In another example embodiment, a device is provided. The device may include, but is not limited to, a housing, a switch, a knob control rod, and the knob assembly. The housing may include, but is not limited to, one or more walls. The switch is configured to control operation of a component of the device. The knob control rod is connected to the switch to control operation of the switch. The knob assembly is mounted to a first wall of the one or more walls.

In another example embodiment, a gas cooktop is provided. The gas cooktop may include, but is not limited to, a housing, a grate, a burner, a valve, a knob control rod, and the knob assembly. The housing may include, but is not limited to, one or more walls. The grate is mounted on the housing. The grate forms a horizontal support surface for a cooking receptacle. The burner is mounted below the grate. The valve is configured to control operation of the burner. The knob control rod is connected to the valve. The knob assembly is mounted to a first wall of the one or more walls.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
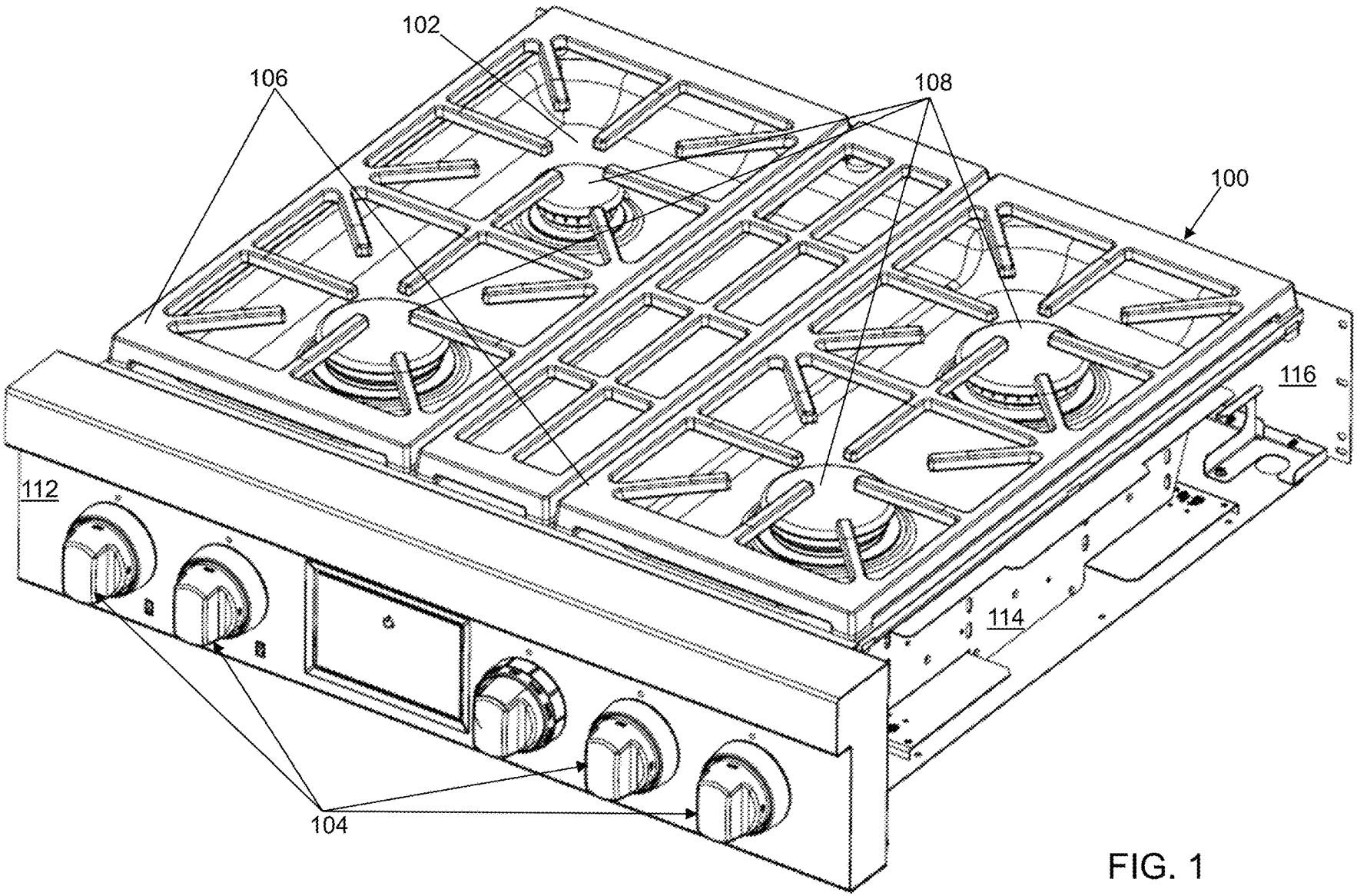
FIG. 1 depicts a top, front perspective view of a cooktop in accordance with an illustrative embodiment.

Referring to FIG. 1, a top, front perspective view of a cooktop 100 is shown in accordance with an illustrative embodiment. Cooktop 100 may include a burner pan 102, a plurality of control knobs 104, one or more grates 106, a plurality of burners 108, and. Cooktop 100 further may include a left housing wall 200 (shown referring to FIG. 2A), a front housing wall 112, a right housing wall 114, and a back housing wall 116 that form a housing for the plurality of burners 108 and associated components of cooktop 100. Cooktop 100 may include a greater or a fewer number of components. The one or more components of cooktop 100 may be formed of one or more materials, such as various metals, glass, and/or plastics having a sufficient strength and rigidity as well as thermal and permeability properties sufficient to support the described application. Each grate of the one or more grates 106 mount above burner pan 102 and extend over the plurality of burners 108 to support various cooking receptacles as understood by a person of skill in the art. Each grate of the one or more grates 106 may have various prong designs and mounting arrangements.

The plurality of burners 108 are mounted through apertures in front housing wall 112. The plurality of burners 108 provide a flame to heat the various cooking receptacles placed on the one or more grates 106. The burners may be single or multiple level burners, such as a dual stack burner. Merely for illustration, each burner may be implemented similar to the stacked dual gas burner described in U.S. Pat. No. 6,322,354. Other gas burner designs may be used in alternative embodiments. The plurality of burners 108 may be arranged in manners other than that shown in the illustrative embodiment of FIG. 1. The plurality of burners 108 further may be electric burners of various types such as induction burners in alternative embodiments.

A control knob of the plurality of control knobs 104 controls a respective burner of the plurality of burners 108. There may be a fewer or a greater number of the plurality of control knobs 104 and the plurality of burners 108. In the illustrative embodiment, the plurality of control knobs 104 are mounted vertically with respect to the plurality of burners 108 though other orientations may be used in alternative embodiments. Though described herein as controlling operation of a respective burner of cooktop 100, each control knob of the plurality of control knobs 104 may be mounted to control operation of other devices.

In the illustrative embodiment, each burner of the plurality of burners 108 is a dual stack burner. A gas line connects between each stack of each burner of the plurality of burners 108 and a control knob of the plurality of control knobs 104. For illustration, a lower burner gas line may provide a simmer flame, and an upper burner gas line may provide a main cooking flame. Each lower burner gas line and upper burner gas line may be small metallic tubes. For illustration, each lower burner gas line and upper burner gas line may be formed of stainless steel or aluminum tubing. Each pair of gas lines connects between an associated control knob and burner of the plurality of burners 108.

Cooktop 100 further may include a gas manifold 208. Gas manifold 208 extends in line with the plurality of control knobs 104 though behind front housing wall 112 so that it is not visible by the user. A main gas line (not shown) provides an entry port for gas that is provided to one or more of the plurality of burners 108 under control of a respective control knob of the plurality of control knobs 104. For example, the user adjusts a flame height from a burner of the plurality of burners 108 by rotating a respective control knob.

Figure 2A:
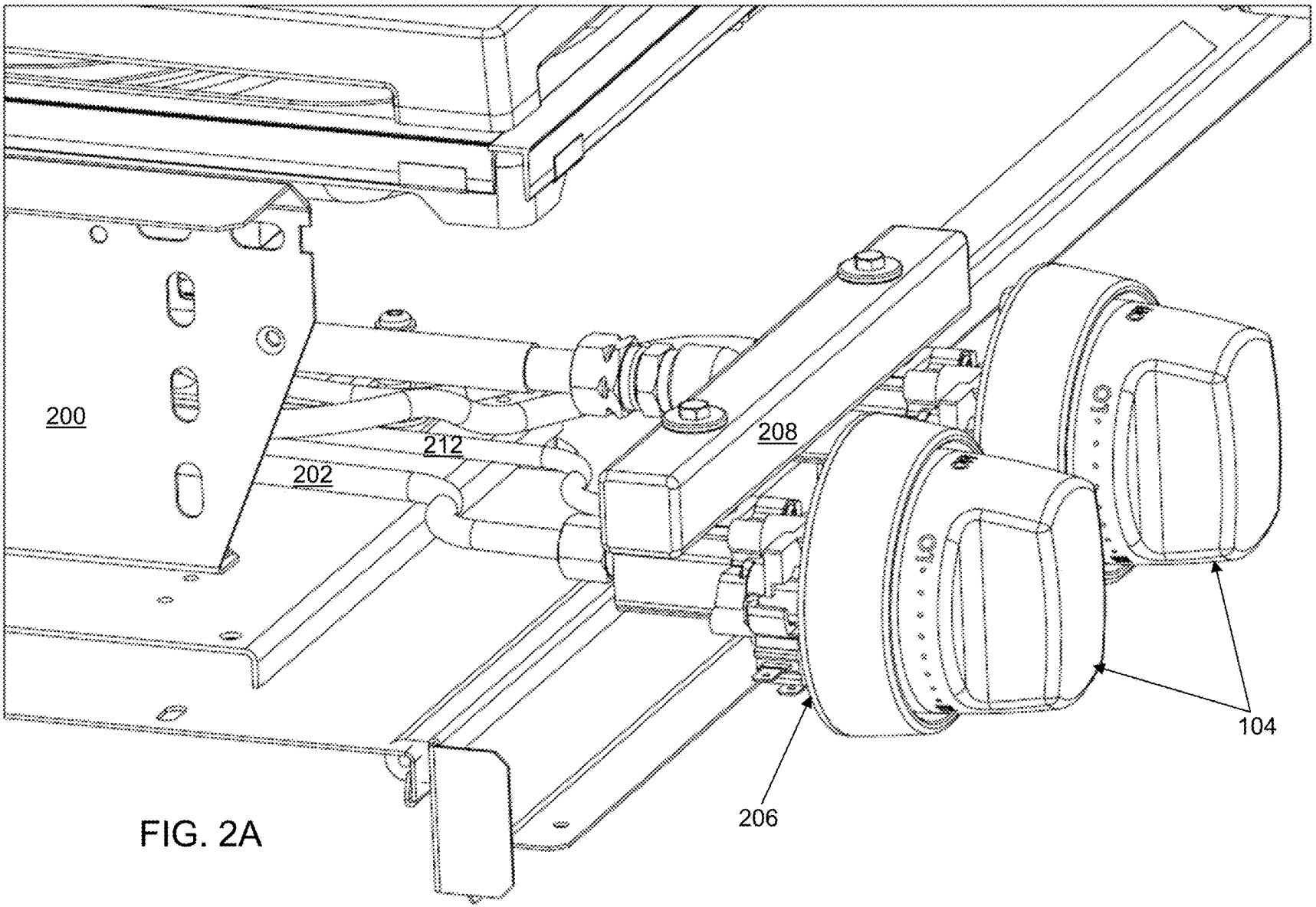
FIG. 2A depicts a front left perspective view of a knob-valve assembly of the cooktop of FIG. 1 in accordance with an illustrative embodiment.
Figure 2B:
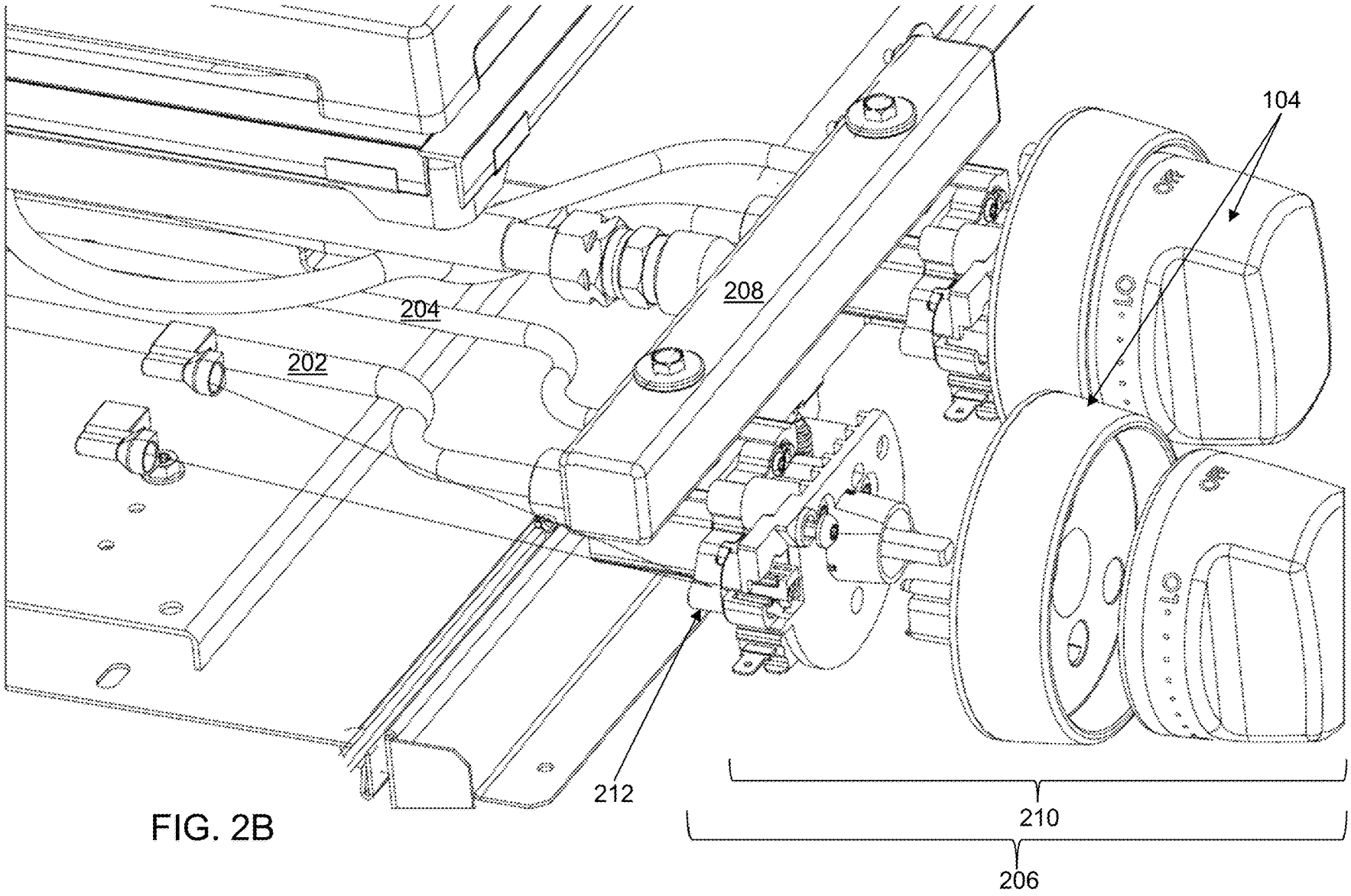
FIG. 2B depicts the front left perspective view of FIG. 2A with part of the knob-valve assembly exploded in accordance with an illustrative embodiment.

Referring to FIGS. 2A and 2B, a first upper burner gas line 202 and a first lower burner gas line 204 mount to a first burner of the plurality of burners 108 and to a first knob-valve assembly 206 when the plurality of burners 108 is a dual stack burner. Though not required, each control knob of the plurality of control knobs 104 may be similar or identical to first knob-valve assembly 206, which is described for illustration. First knob-valve assembly 206 may include a knob assembly 210 and a valve 212. In an alternative embodiment, one or more burners of the plurality of burners 108 may not be a multiple stack burner such as a dual stack burner. Thus, each first knob-valve assembly 206 may connect to a fewer or a greater number of gas lines. In the illustrative embodiment, knob assembly 210 is mounted to valve 212 because knob assembly controls operation of one or more of the plurality of burners 108. In alternative embodiments, knob assembly 210 may not be mounted to valve 212 and may instead be mounted to an alternative mechanism to be controlled by knob assembly 210. For example, a different valve may be used. The different valve may support a flow of non-combustible gas or a fluid such as water or air. In an alternative embodiment, knob assembly 210 may be connected to a switch (not shown) used to control operation of a different type of device. For example, the switch may turn on an electric burner of a stove, an oven, or a cooktop. In other alternative embodiments, knob assembly 210 may be mounted to control operation of devices other than cooking equipment.

Figure 3:
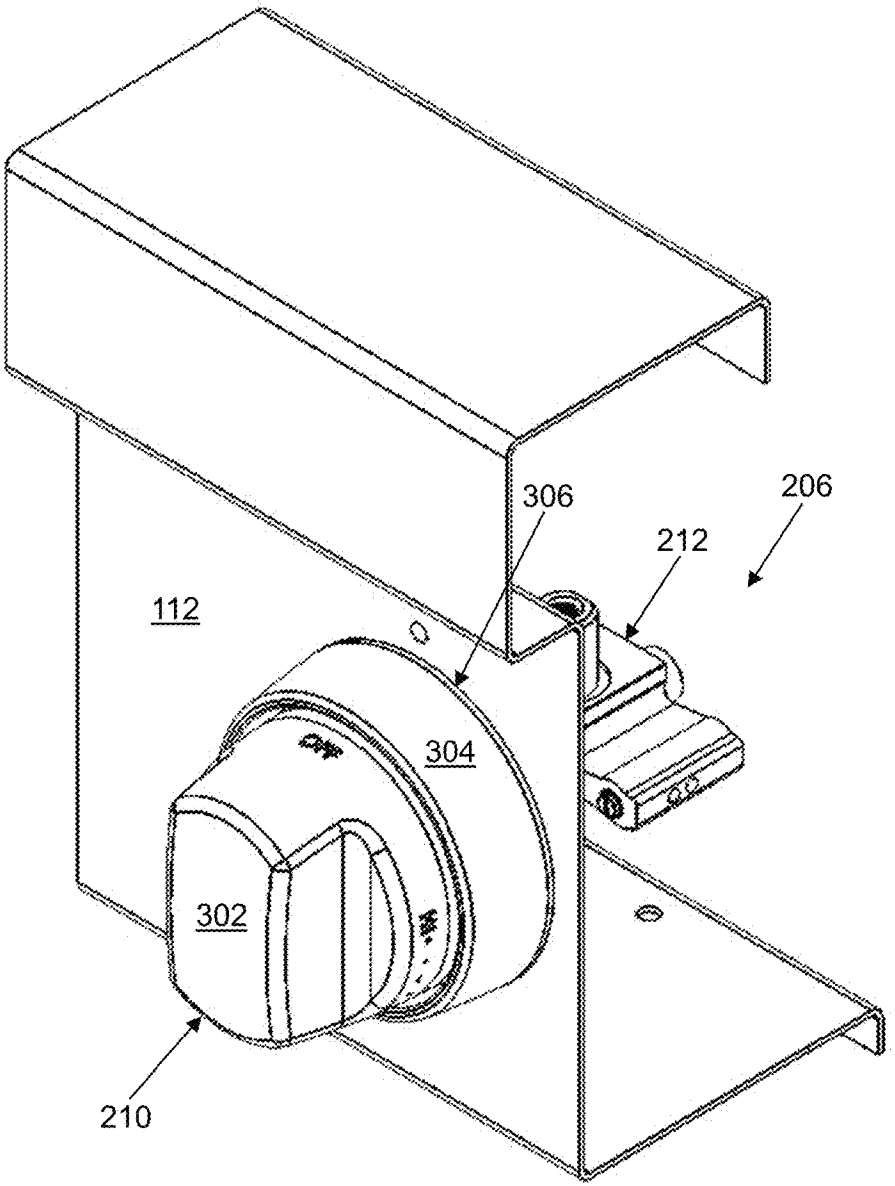
FIG. 3 depicts a front perspective view of the knob-valve assembly of FIG. 2 disconnected from the cooktop in accordance with an illustrative embodiment.
Figure 4:
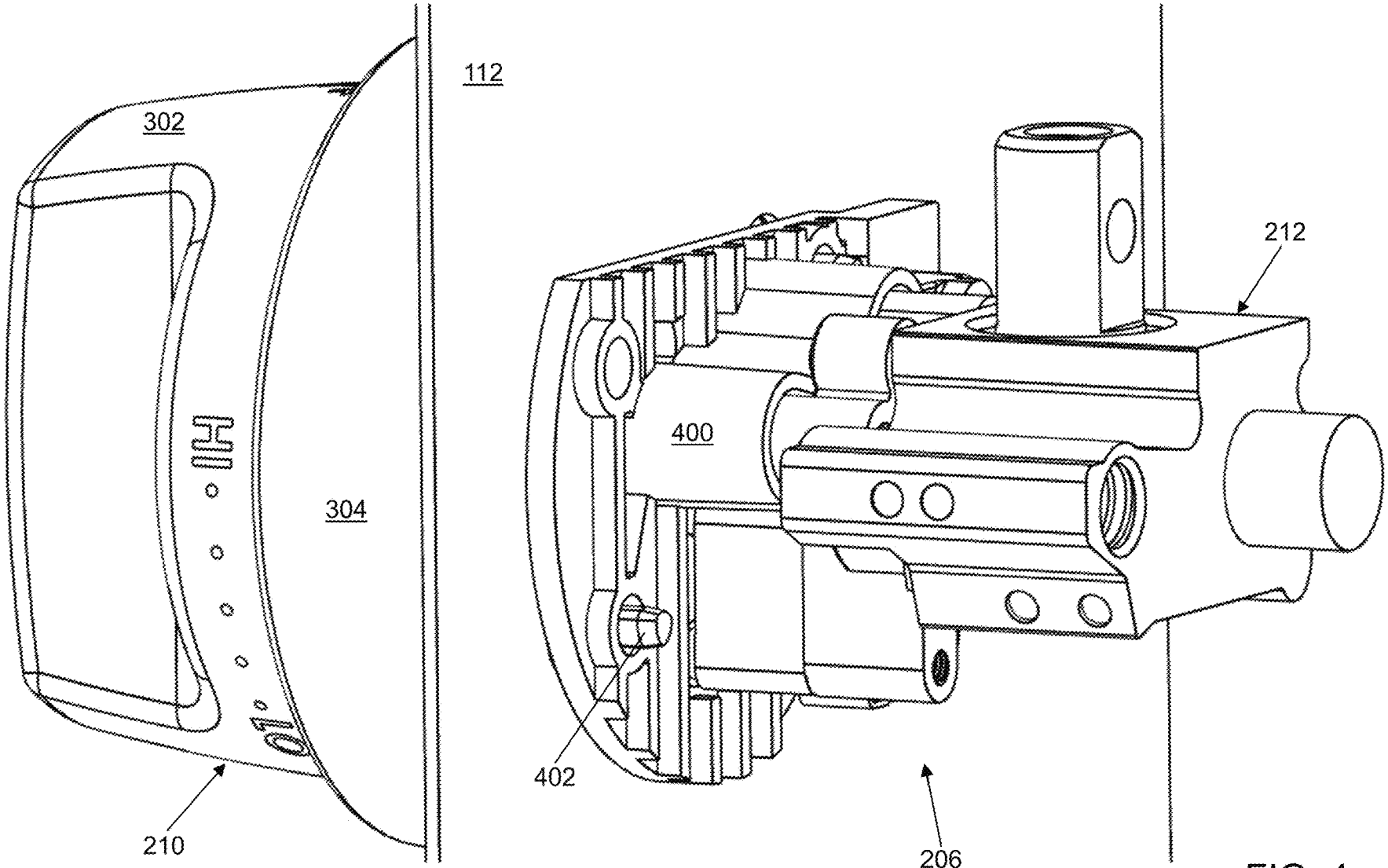
FIG. 4 depicts a back perspective view of the knob-valve assembly of FIG. 3 in accordance with an illustrative embodiment.
Figure 5:
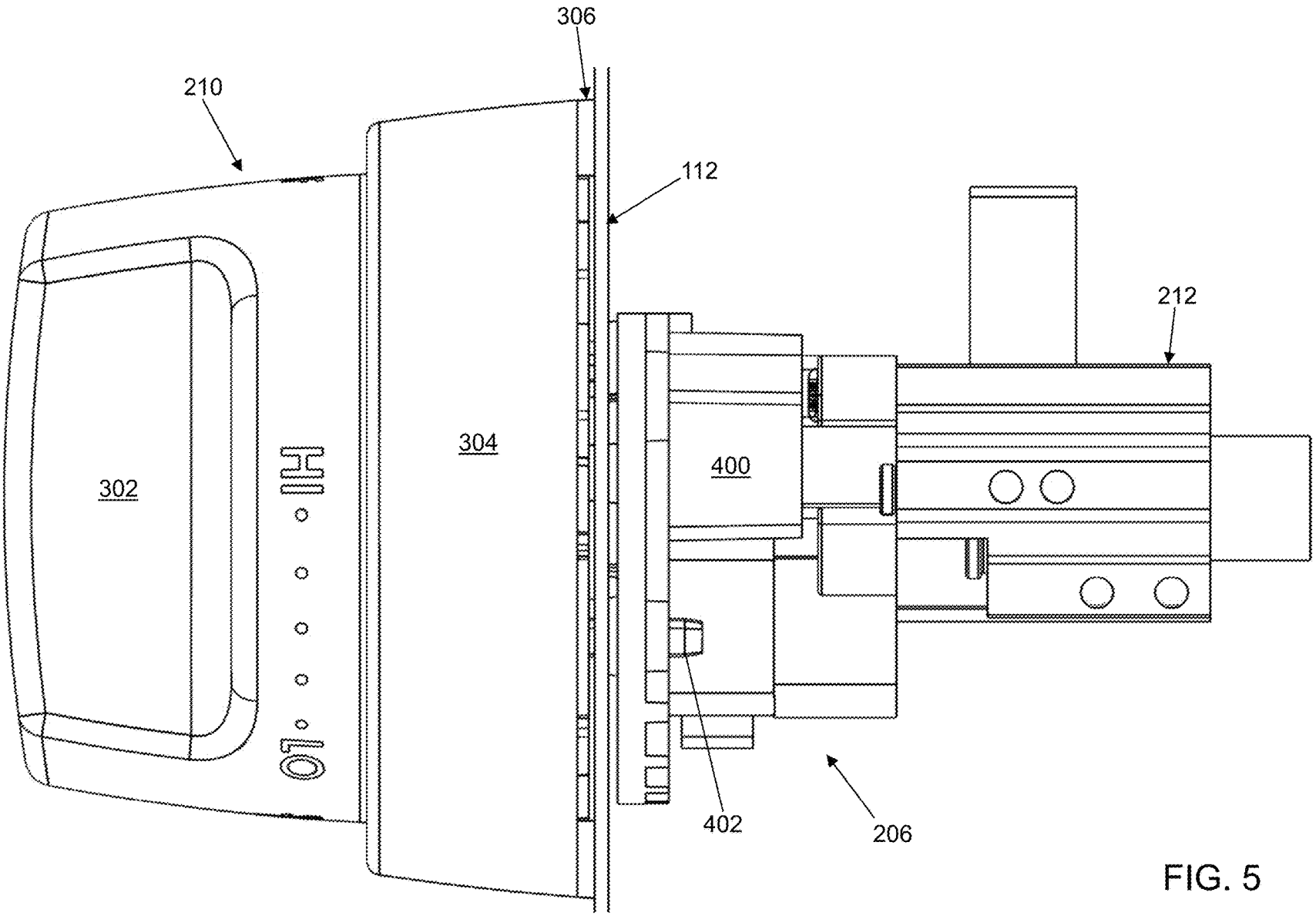
FIG. 5 depicts a right side view of the knob-valve assembly of FIG. 3 in accordance with an illustrative embodiment.

Referring to FIG. 3, a front perspective view of first knob-valve assembly 206 mounted to front housing wall 112 of cooktop 100 is shown in accordance with an illustrative embodiment. Referring to FIG. 4, a back perspective view of first knob-valve assembly 206 is shown in accordance with an illustrative embodiment. Referring to FIG. 5, a right side view of first knob-valve assembly 206 is shown in accordance with an illustrative embodiment. Knob assembly 210 may include a knob 302, a bezel 304, a light assembly 306, a light socket 900 (shown referring to FIG. 9), a receptacle 400, a first bezel fastener 402, a second bezel fastener 800 (shown referring to FIG. 8), a first receptacle fastener 1002 (shown referring to FIG. 10), and a second receptacle fastener 1004 (shown referring to FIG. 10). At least a portion of light assembly 306 generally mounts flush with a first side of front housing wall 112 on which knob 302 is located, and at least a portion of receptacle 400 generally mounts flush with a second side of front housing wall 112 on which valve 212 is located. When used, only knob 302 and a valve control rod 708 (shown referring to FIG. 7) of valve 212 move to control an amount of gas from valve 212 provided to the respective burner.

An illustrative fastener may be a screw, a rivet, a bolt, a nail, etc. In alternative embodiments, other methods of fastening further may be used such as an adhesive such as glue or tape, soldering, etc. A greater or a fewer number of fasteners may be used to mount various elements together in alternative embodiments instead of those shown for illustration. Additionally, different types of fasteners or combinations of fasteners may be used in alternative embodiments instead of those shown for illustration.

Figure 6:
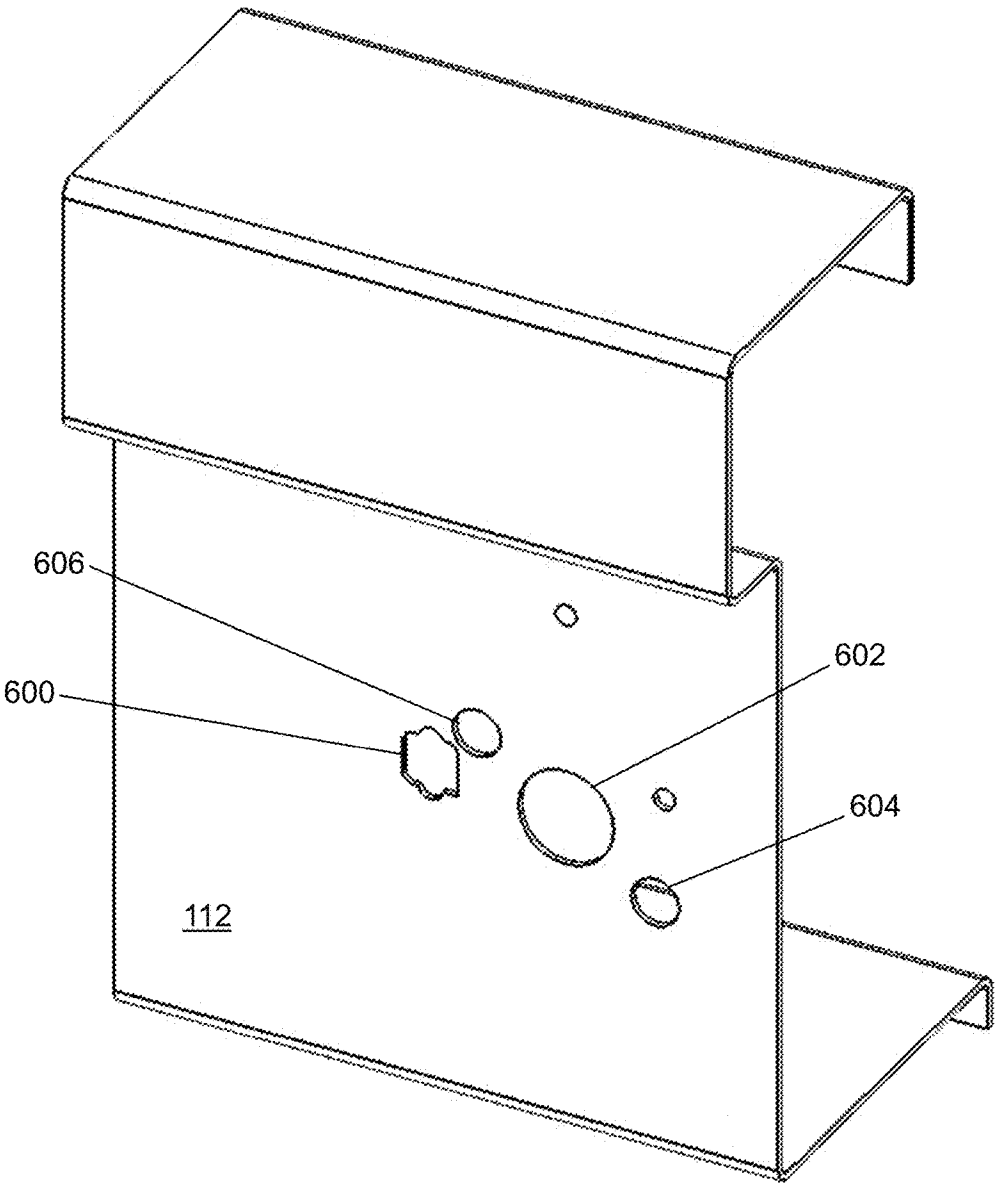
FIG. 6 depicts a front perspective view of a knob mounting plate of the knob-valve assembly of FIG. 3 in accordance with an illustrative embodiment.

Referring to FIG. 6, a front perspective view of front housing wall 112 is shown in accordance with an illustrative embodiment. Front housing wall 112 may be part of a control panel of a device to which knob 302 is mounted. In the illustrative embodiment, the device is cooktop 100. Front housing wall 112 may include a light connector aperture wall 600, a receptacle aperture wall 602, a first bezel fastener aperture wall 604, and a second bezel fastener aperture wall 606 for each control knob of the plurality of control knobs 104. Light connector aperture wall 600 forms an aperture through front housing wall 112 that is sized and shaped to accept a first connector housing 1818 (shown referring to FIG. 18B) of receptacle 400. Receptacle aperture wall 602 forms an aperture through front housing wall 112 that is sized and shaped to accept a receptacle mounting protrusion 802 (shown referring to FIG. 8) of receptacle 400. First bezel fastener aperture wall 604 forms an aperture through front housing wall 112 that is sized and shaped to accept a first fastener shaft aperture wall 2014 (shown referring to FIG. 20A) of receptacle 400, and second bezel fastener aperture wall 606 forms an aperture through front housing wall 112 that is sized and shaped to accept a second fastener shaft aperture wall 2016 (shown referring to FIG. 20A).

Figure 7:
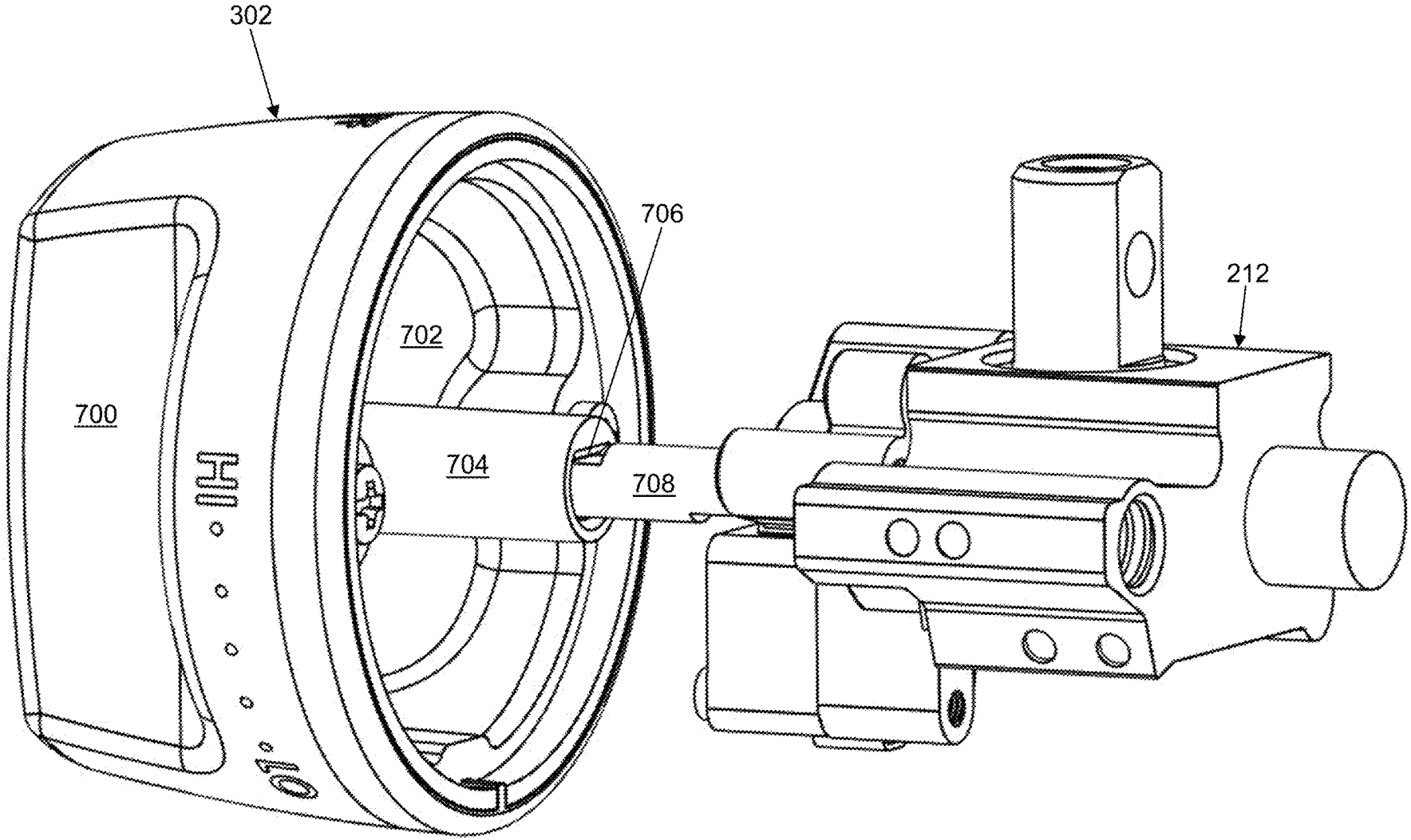
FIG. 7 depicts a back, right perspective view of a knob of a knob assembly of FIG. 3 connected to a valve of the knob-valve assembly of FIG. 3 in accordance with an illustrative embodiment.

Referring to FIG. 7, a back, right perspective view of knob 302 of knob assembly 210 connected to valve 212 is shown in accordance with an illustrative embodiment with intermediate parts removed for clarity. Knob 302 may include a knob exterior surface 700, a knob interior surface 702, a knob mounting protrusion 704, and a knob mounting aperture wall 706. Knob exterior surface 700 is visible to a user when knob 302 is mounted for use, for example, to front housing wall 112 of cooktop 100. Knob interior surface 702 is on an opposite side of knob exterior surface 700. Knob mounting protrusion 704 extends away from knob interior surface 702 toward valve 212 when mounted to valve 212. Valve 212 may include valve control rod 708 that extends towards knob mounting protrusion 704 when knob 302 is mounted to valve 212. Knob mounting aperture wall 706 is formed in knob mounting protrusion 704 and is sized and shaped so that a tip mounting portion 1314 (shown referring to FIG. 13) of valve control rod 708 fits therein such that, when knob 302 is mounted to valve 212, tip mounting portion 1314 of valve control rod 708 is rotated with knob 302 to control the flow of gas in the illustrative embodiment.

Figure 8A:
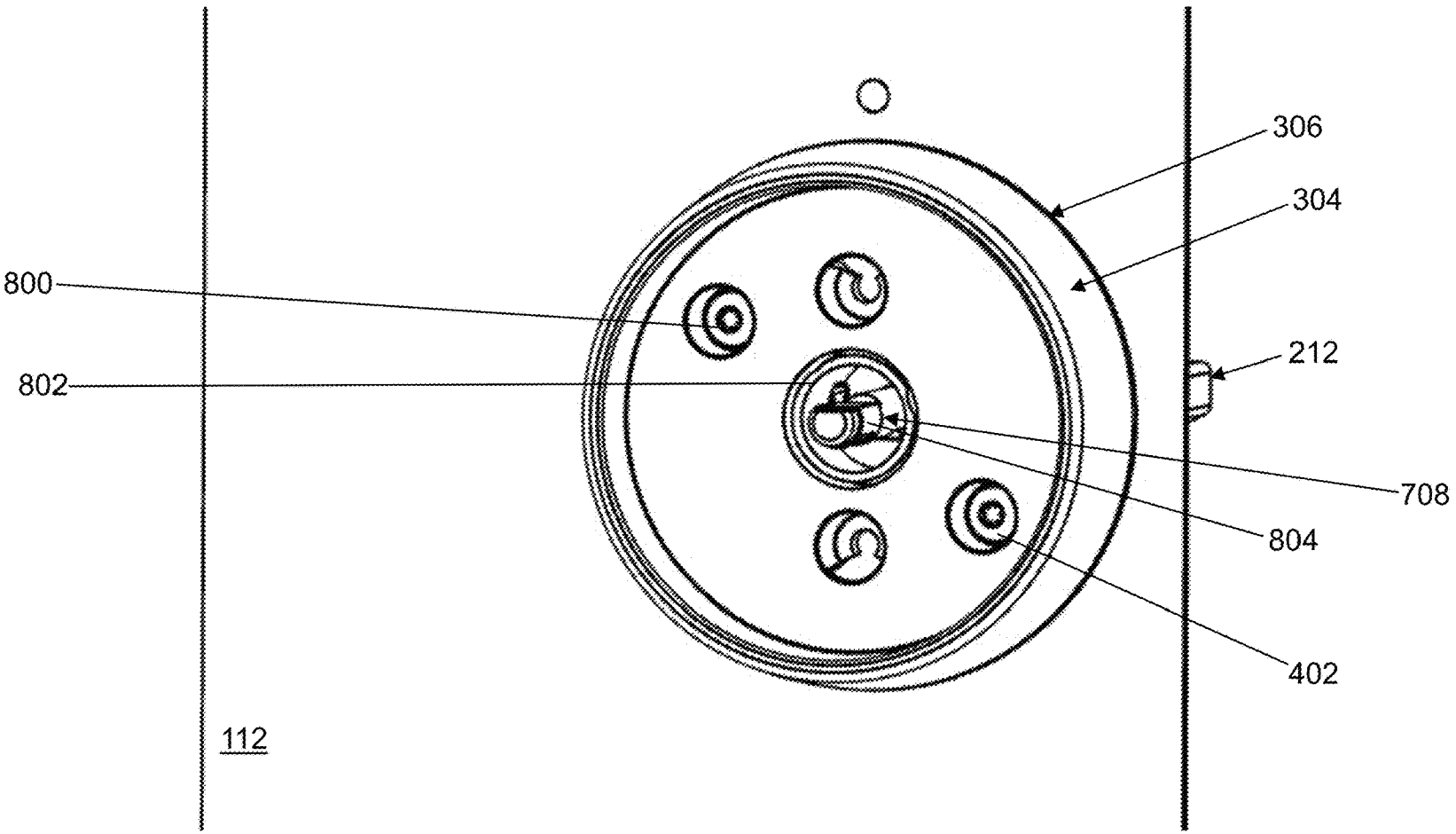
FIG. 8A depicts a front perspective view of a bezel of the knob-valve assembly of FIG. 3 mounted to the knob mounting plate of FIG. 6 in accordance with an illustrative embodiment.

Referring to FIG. 8A, a front perspective view of bezel 304 mounted to front housing wall 112 is shown in accordance with an illustrative embodiment. Knob 302 has been dismounted, for example, by sliding knob mounting protrusion 704 horizontally away from and off of valve control rod 708. Receptacle mounting protrusion 802 has been inserted into receptacle aperture wall 602 and into a second receptacle aperture wall 1704 (shown referring to FIG. 17A) formed through bezel 304. First bezel fastener 402 has been inserted into a first bezel fastener head aperture wall 1706 (shown referring to FIG. 17A) formed through bezel 304 that fits within first bezel fastener aperture wall 604. Second bezel fastener 800 has been inserted into a second bezel fastener head aperture wall 1708 (shown referring to FIG. 17A) formed through bezel 304 that fits within second bezel fastener aperture wall 606. A portion of valve control rod 708 extends through receptacle mounting protrusion 802 so that knob 302 can be mounted to valve control rod 708 after mounting bezel 304 to light assembly 306.

Figure 8B:
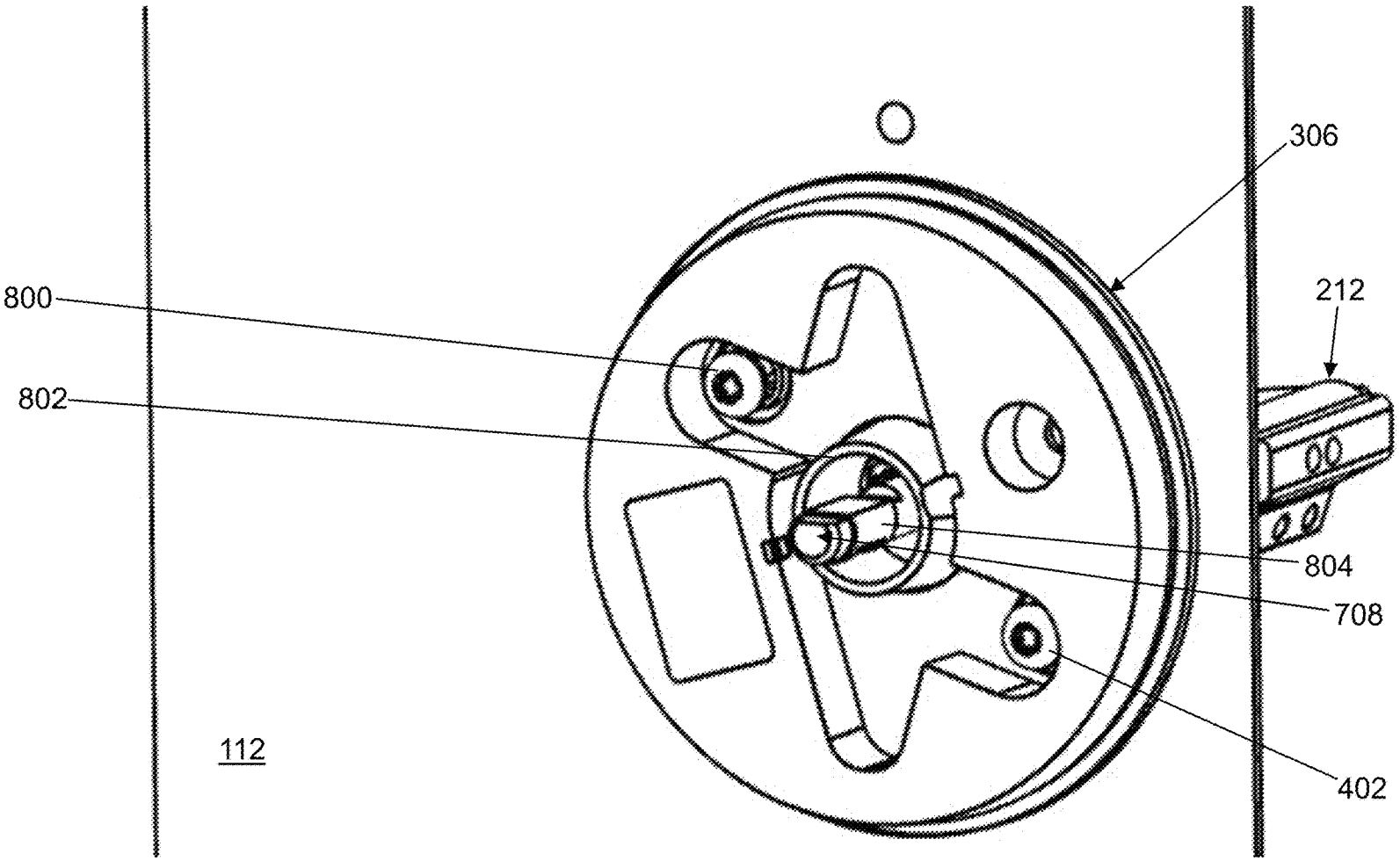
FIG. 8B depicts a front perspective view of a light assembly of the knob-valve assembly of FIG. 3 mounted to the knob mounting plate of FIG. 6 in accordance with an illustrative embodiment.

Referring to FIG. 8B, a front perspective view of light assembly 306 mounted to front housing wall 112 is shown in accordance with an illustrative embodiment. Knob 302 and bezel 304 have been removed. For example, bezel 304 may have been removed by unfastening first bezel fastener 402 and second bezel fastener 800 though first bezel fastener 402 and second bezel fastener 800 are shown in FIG. 8B to illustrate their mounting to light assembly 306. Receptacle mounting protrusion 802 has been inserted through mounting aperture wall 1804 (shown referring to FIG. 18A) formed through light assembly 306. First bezel fastener 402 has been inserted into first fastener shaft aperture wall 2014 of receptacle 400 that fits within first bezel fastener aperture wall 604. Second bezel fastener 800 has been inserted into second fastener shaft aperture wall 2016 of receptacle 400 that fits within second bezel fastener aperture wall 606. Again, first bezel fastener 402 and second bezel fastener 800 are shown for reference to their positioning relative to light assembly 306 though first bezel fastener 402 and second bezel fastener 800 are removed to allow removal of bezel 304.

Figure 9:
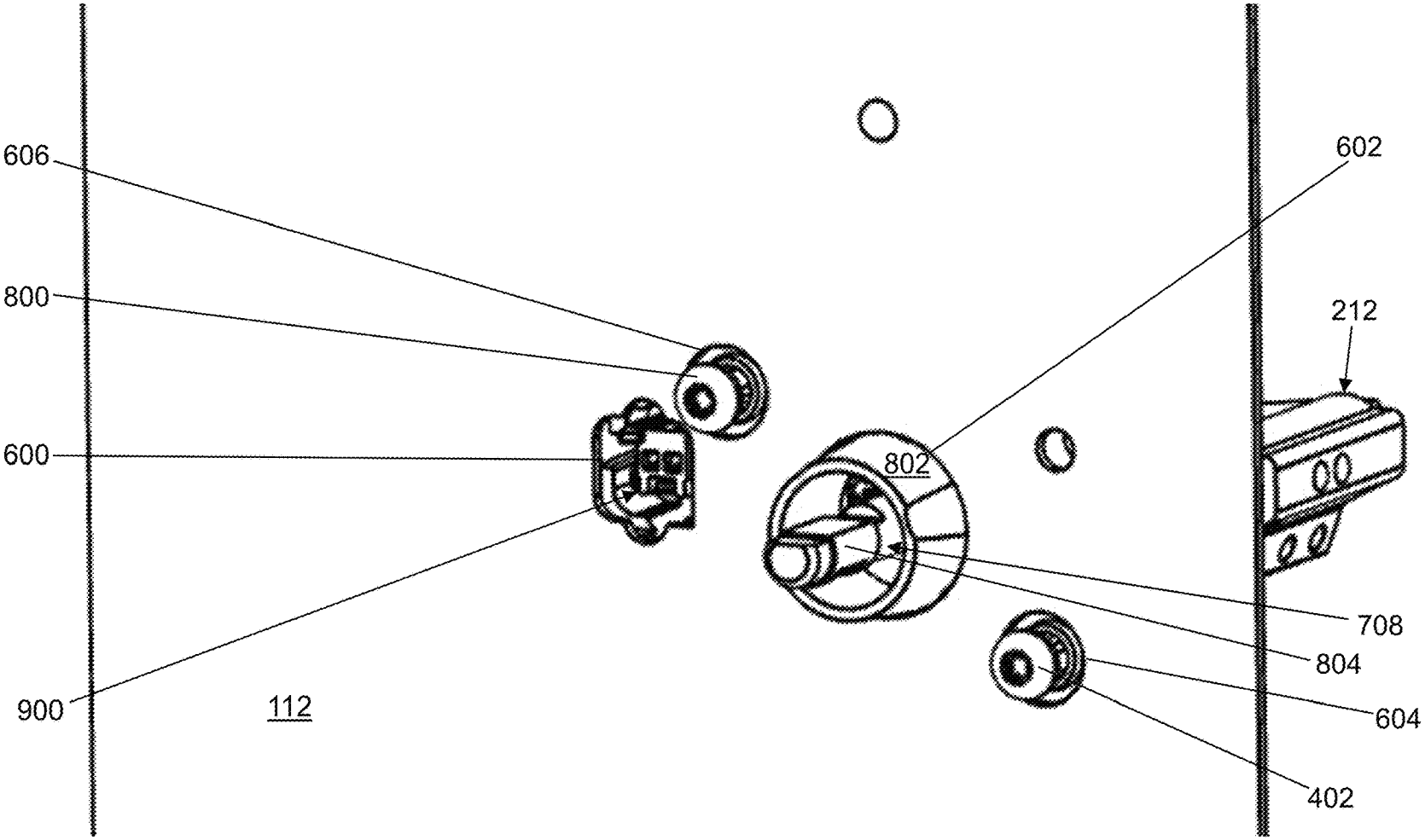
FIG. 9 depicts a front perspective view of a receptacle of the knob-valve assembly of FIG. 3 mounted to the valve and to the knob mounting plate of FIG. 6 in accordance with an illustrative embodiment.

Referring to FIG. 9, a front perspective view of receptacle 400 of knob assembly 210 mounted to front housing wall 112 is shown in accordance with an illustrative embodiment. First bezel fastener 402 and second bezel fastener 800 are shown for reference to their positioning relative to receptacle 400 though first bezel fastener 402 and second bezel fastener 800 are removed to allow removal of bezel 304 and light assembly 306. Light socket 900 mounts within a second connector housing 2010 (shown referring to FIG. 20A) of receptacle 400. Second connector housing 2010 has been aligned with and inserted partially with light connector aperture wall 600.

Figure 10:
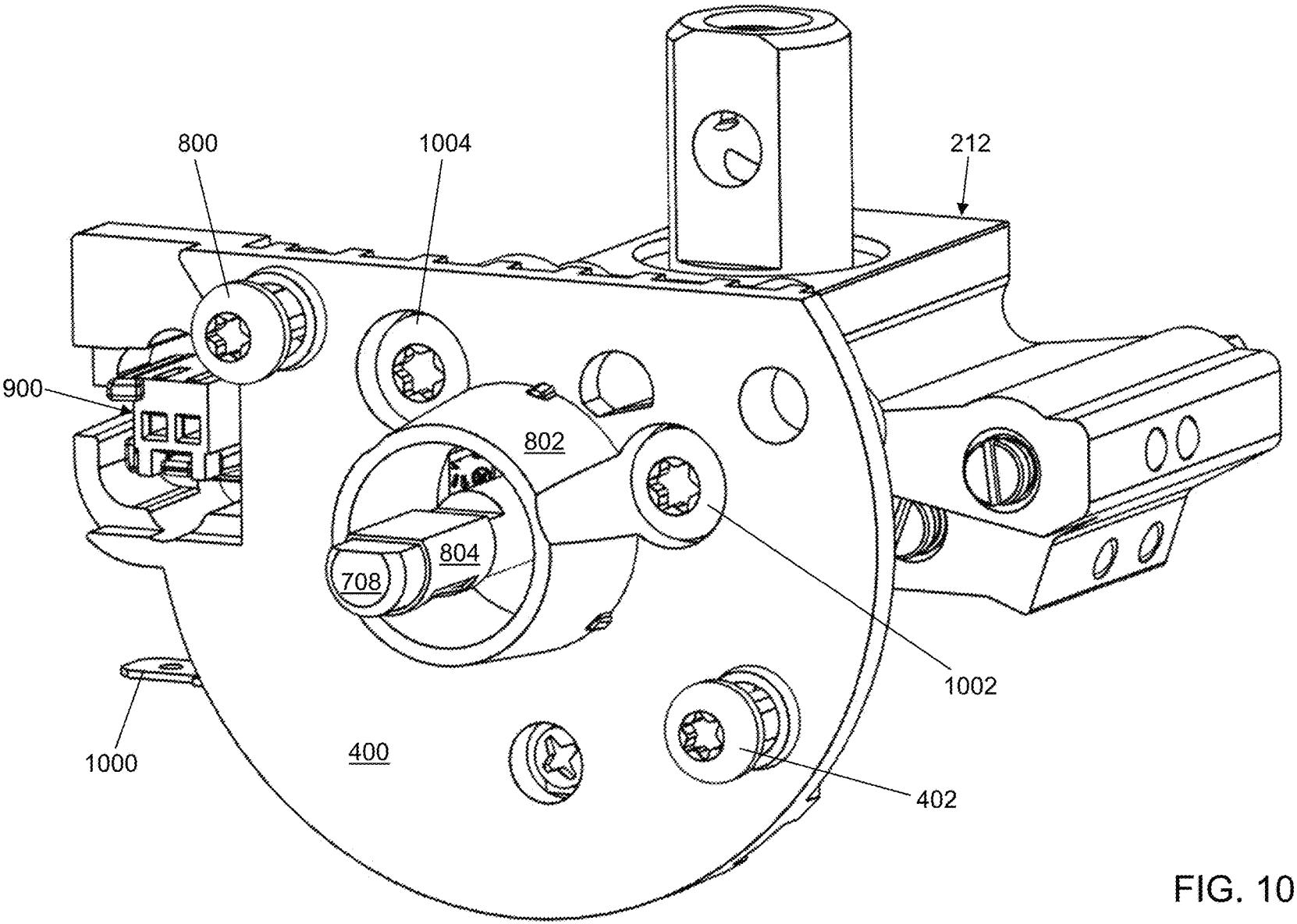
FIG. 10 depicts a front perspective view of the receptacle of the knob assembly of FIG. 3 connected to the valve of the knob-valve assembly of FIG. 3 in accordance with an illustrative embodiment.

Referring to FIG. 10, a front perspective view of receptacle 400 of knob assembly 210 mounted to valve 212 is shown in accordance with an illustrative embodiment. First bezel fastener 402 and second bezel fastener 800 are shown for reference to their positioning relative to receptacle 400 though first bezel fastener 402 and second bezel fastener 800 are removed to allow removal of bezel 304. Valve electrical connectors 1000 extend from valve 212. First receptacle fastener 1002 and second receptacle fastener 1004 mount receptacle 400 to valve 212 in the illustrative embodiment. A knob spring 804 is mounted within knob mounting aperture wall 706 and is sized and shaped so that tip mounting portion 1314 of valve control rod 708 fits therein such that, when knob 302 is mounted to valve 212 and depressed, knob spring 804 slides along tip mounting portion 1314 of valve control rod 708 toward valve 212 and slides along tip mounting portion 1314 of valve control rod 708 away from valve 212 when knob 302 is released as discussed further below. Though knob spring 804 is shown mounted on valve control rod 708 without knob 302 in FIGS. 8A, 8B, 9, and 10, knob spring 804 remains fixed within knob mounting aperture wall 706 when knob 302 is dismounted from valve control rod 708.

Figure 11:
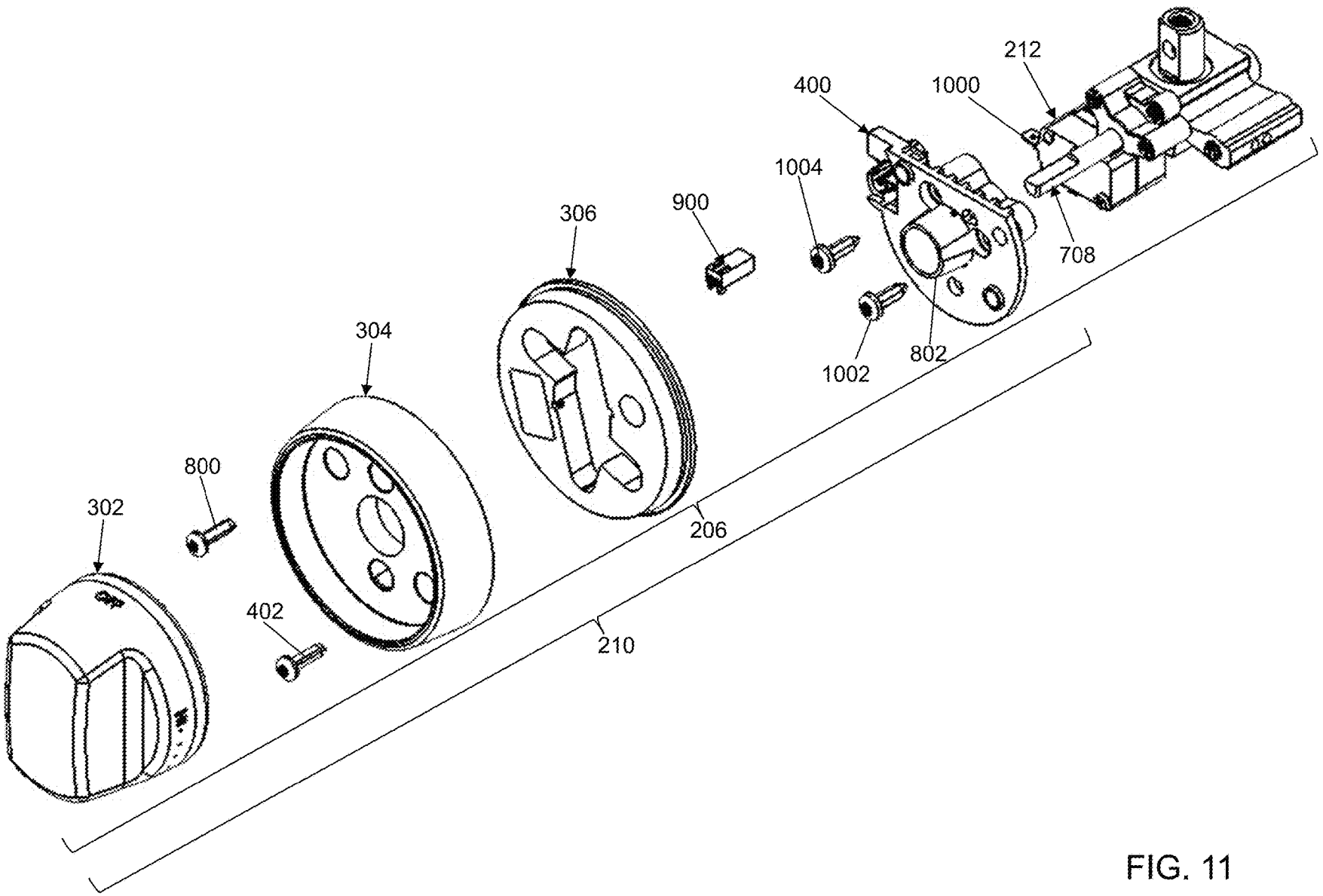
FIG. 11 depicts an exploded front perspective view of the knob-valve assembly of FIG. 3 in accordance with an illustrative embodiment.
Figure 12:
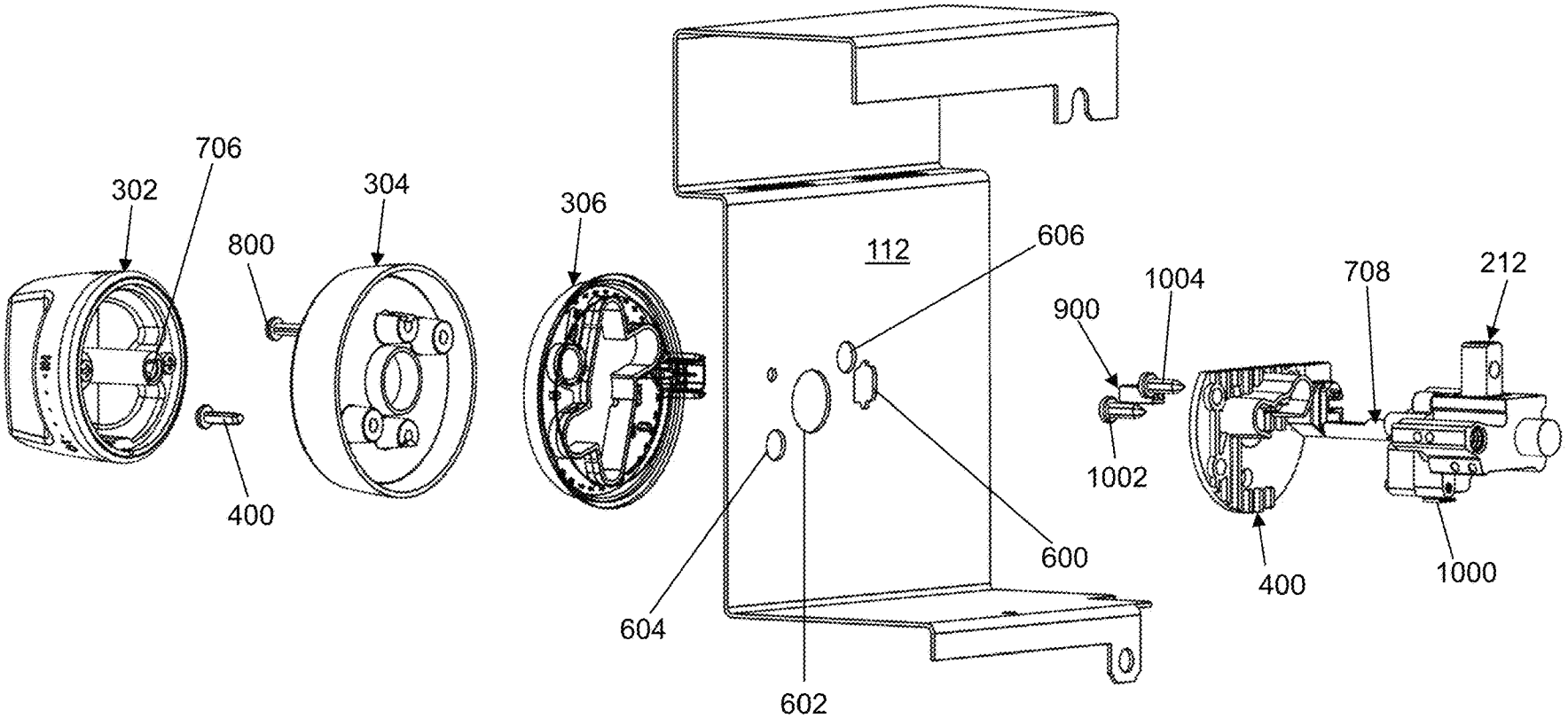
FIG. 12 depicts an exploded back perspective view of the knob-valve assembly of FIG. 3 in accordance with an illustrative embodiment.

Referring to FIG. 11, an exploded front perspective view of first knob-valve assembly 206 is shown in accordance with an illustrative embodiment. Referring to FIG. 12, an exploded back perspective view of first knob-valve assembly 206 with front housing wall 112 is shown in accordance with an illustrative embodiment.

Figure 13:
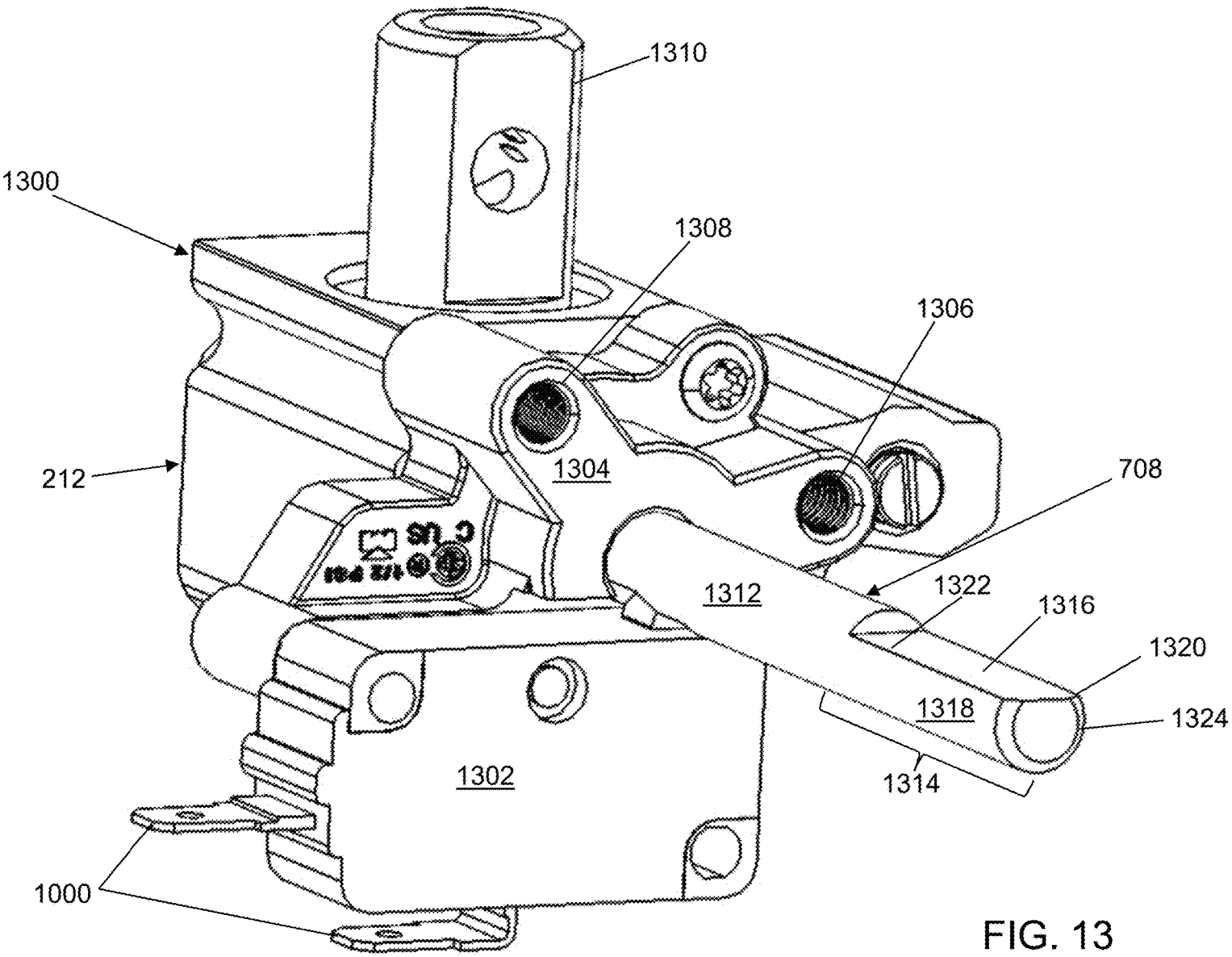
FIG. 13 depicts a front, left perspective view of the valve of the knob-valve assembly of FIG. 3 in accordance with an illustrative embodiment.
Figure 14:
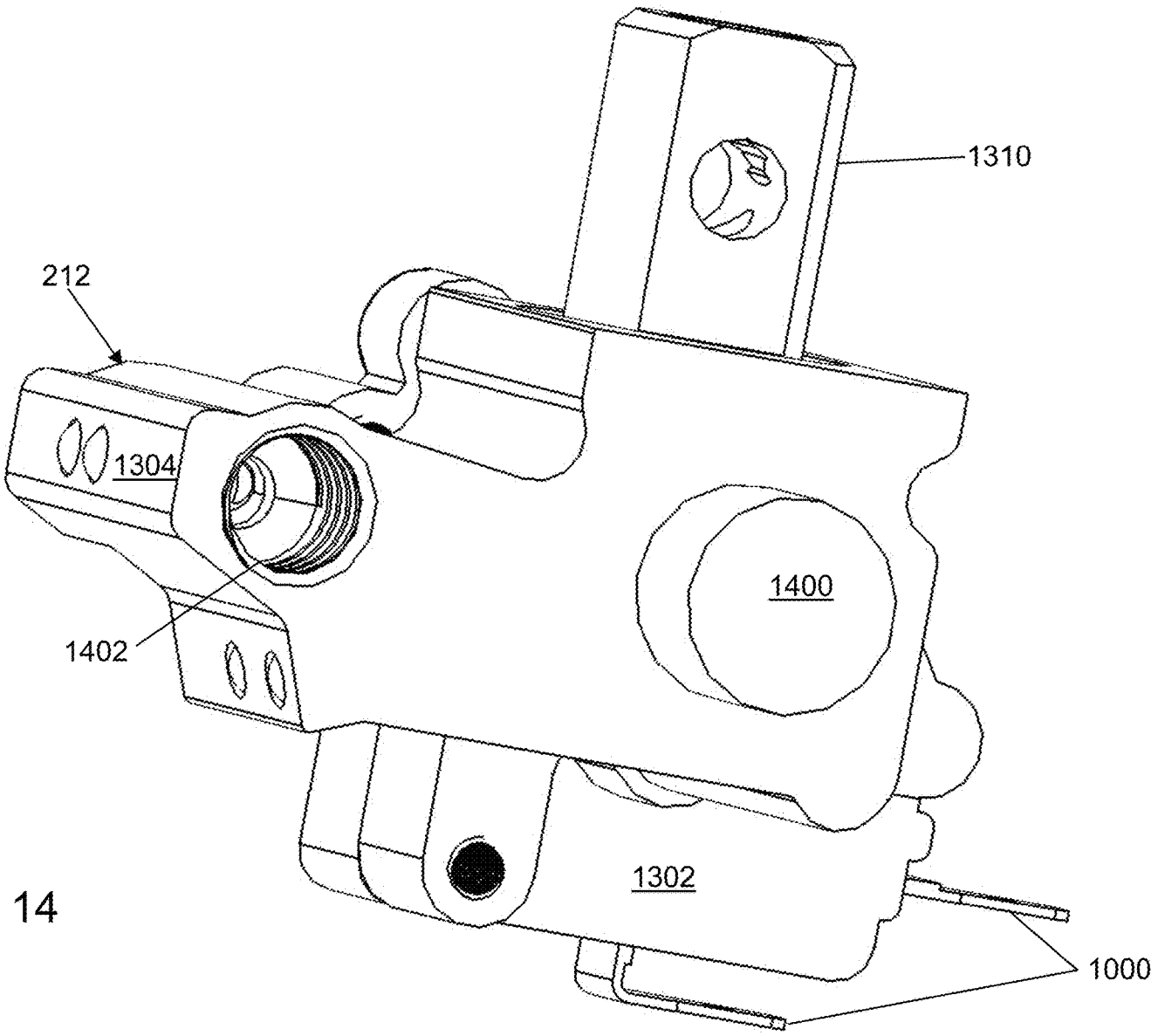
FIG. 14 depicts a back, right perspective view of the valve of FIG. 13 in accordance with an illustrative embodiment.
Figure 15:
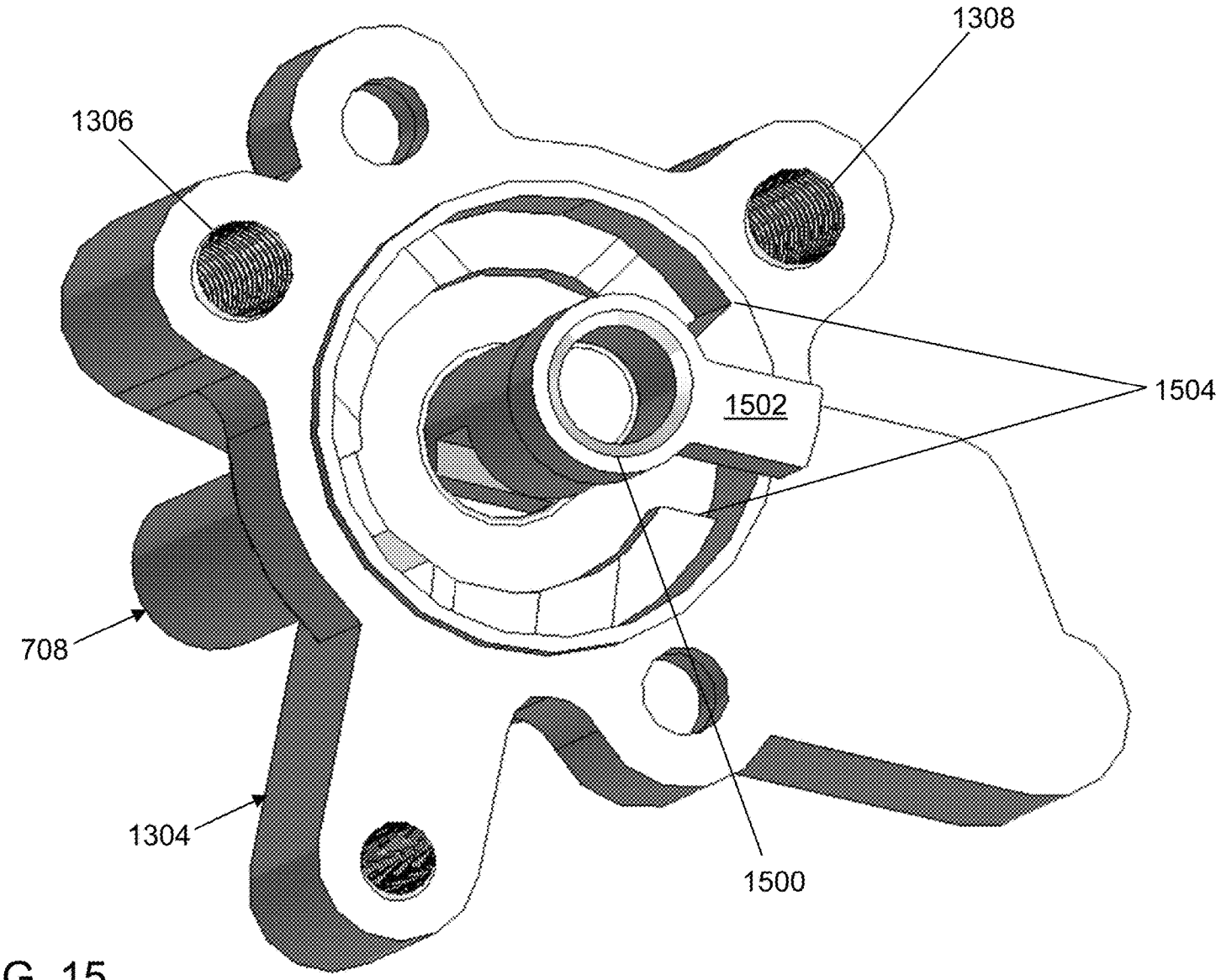
FIG. 15 depicts a back, right perspective view of an interior of the valve of FIG. 13 in accordance with an illustrative embodiment.

Referring to FIG. 13, a front, left perspective view of valve 212 of first knob-valve assembly 206 is shown in accordance with an illustrative embodiment. Referring to FIG. 14, a back, right perspective view of valve 212 is shown in accordance with an illustrative embodiment. Referring to FIG. 15, a back, right perspective view of a valve detent housing 1304 of valve 212 is shown in accordance with an illustrative embodiment. Valve 212 may include valve electrical connectors 1000, a valve housing 1300, a switch housing 1302, valve detent housing 1304, a valve first fastener wall 1306, a valve second fastener wall 1308, an input gas line connector port 1310, a first burner gas line connector port 1400, and a second burner gas line connector port 1402. Valve detent housing 1304 is mounted between valve housing 1300 and switch housing 1302 using various fastening methods.

Valve electrical connectors 1000 extend from switch housing 1302, which houses a switch (not shown), and provide an electrical connection (not shown) to a power connector to provide power to valve 212. The switch within switch housing 1302 controls power to switch on an igniter of a burner of the plurality of burners associated with knob 302 and to switch on light assembly 306 when knob 302 is depressed and rotated to an ignite or "ON" position. The igniter may be switched off as knob 302 is rotated while light assembly 306 may remain lit. In a dual burner, the igniter may be switched on again as knob 302 is rotated to a second "ON" position.

Input gas line connector port 1310, first burner gas line connector port 1400, and second burner gas line connector port 1402 are formed in valve housing 1300. Valve first fastener wall 1306 and valve second fastener wall 1308 and valve control rod 708 are formed in valve detent housing 1304. Valve first fastener wall 1306 and valve second fastener wall 1308 are sized and shaped to accept the shafts of first receptacle fastener 1002 and second receptacle fastener 1004, respectively, to mount receptacle 400 to valve 212.

Knob control rod 708 may include a cylinder 1312 and tip mounting portion 1314. Cylinder 1312 is generally circular and extends from and through valve detent housing 1304 and into valve housing 1300. Tip mounting portion 1314 may include a control rod flat wall 1316, a control rod curved wall 1318, a first control rod flat wall edge 1320, a second control rod flat wall edge 1322, and a tip end 1324. Control rod flat wall 1316 is cut into a portion of cylinder 1312. Control rod flat wall 1316 is mounted upwards when first knob-valve assembly 206 is assembled and knob 302 is in an "OFF" position. Rotation of knob 302 rotates knob control rod 708 because knob mounting aperture wall 706 is sized and shaped to not allow rotation of tip mounting portion 1314 within knob mounting aperture wall 706. Control rod curved wall 1318 transitions to mounting control rod flat wall 1316 at first control rod flat wall edge 1320 and at second control rod flat wall edge 1322 to provide a rotated "C"-shaped tip end 1324. Tip mounting portion 1314 extends from valve 212 towards knob 302 when first knob-valve assembly 206 is assembled.

Knob control rod 708 may include a valve end 1500 that is an end of knob control rod 708 opposite tip end 1324. Valve end 1500 is mounted within an interior of valve housing 1300. A blocking protrusion 1502 extends from cylinder 1312 adjacent valve end 1500. Blocking protrusion 1502 extends approximately perpendicular to cylinder 1312. Blocking protrusion 1502 fits within detent walls 1504. When knob 302 is depressed, blocking protrusion 1502 is released from detent walls 1504 to allow rotation of knob 302 to select a burner and control the flame height of the selected burner. A cone piece (not shown) may mount to valve end 1500. One or more channels may be formed in the cone piece to control the flow of gas from input gas line connector port 1310 to at least one of first burner gas line connector port 1400 and/or second burner gas line connector port 1402.

Knob 302 directly controls operation of valve 212 to provide gas to a respective burner by mounting directly to knob control rod 708 of valve 212. Valve 212 regulates gas pressure to the respective burner based on a rotation angle of knob 302 by a user. Though not shown, a small wire may extend from valve 212 to the igniter at the respective burner. The igniter receives an electrical current and lights the selected burner flame when knob 302 is depressed and rotated to an ignite or "ON" position. Knob 302 may provide separate rotation angles to control the flow of gas to the upper and lower burners separately.

Each of input gas line connector port 1310, first burner gas line connector port 1400, and/or second burner gas line connector port 1402 may have threaded fittings where the gas line tubes attach. For example, first upper burner gas line 202 may be mounted to first burner gas line connector port 1400, and first lower burner gas line 204 may be mounted to second burner gas line connector port 1402 using threaded fittings. Input gas line connector port 1310 may be mounted to gas manifold 208 by a valve manifold connector using threaded fittings to receive gas from a main gas line of cooktop 100.

Figure 16A:
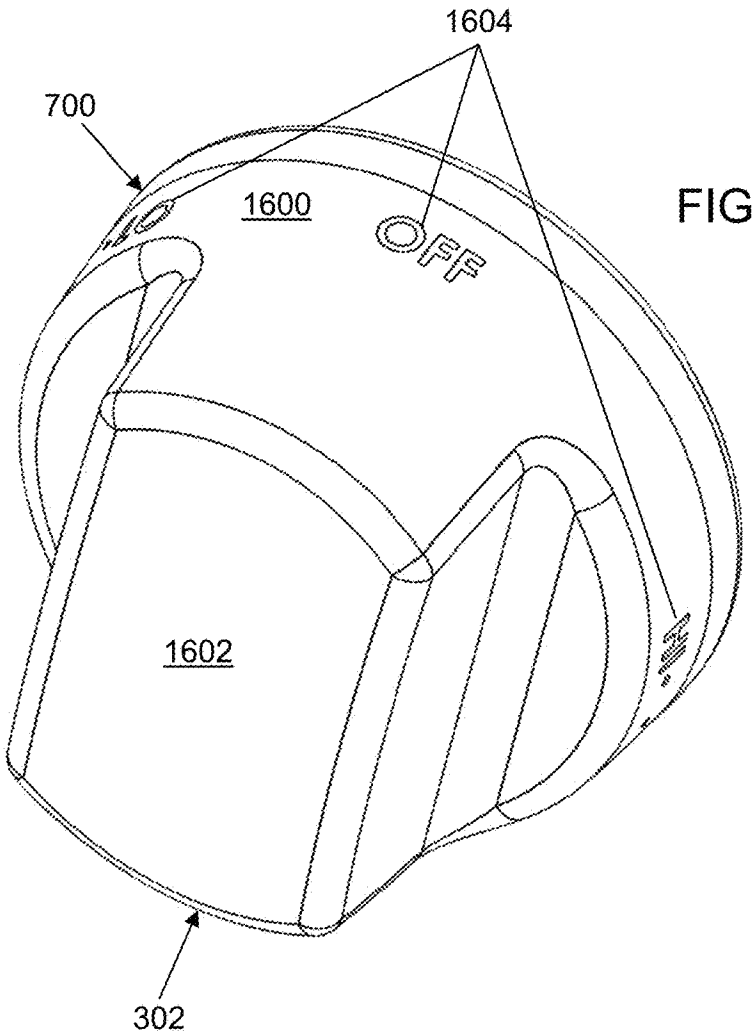
FIG. 16A depicts a front, right perspective view of a knob of the knob assembly of FIG. 3 in accordance with an illustrative embodiment.
Figure 16B:
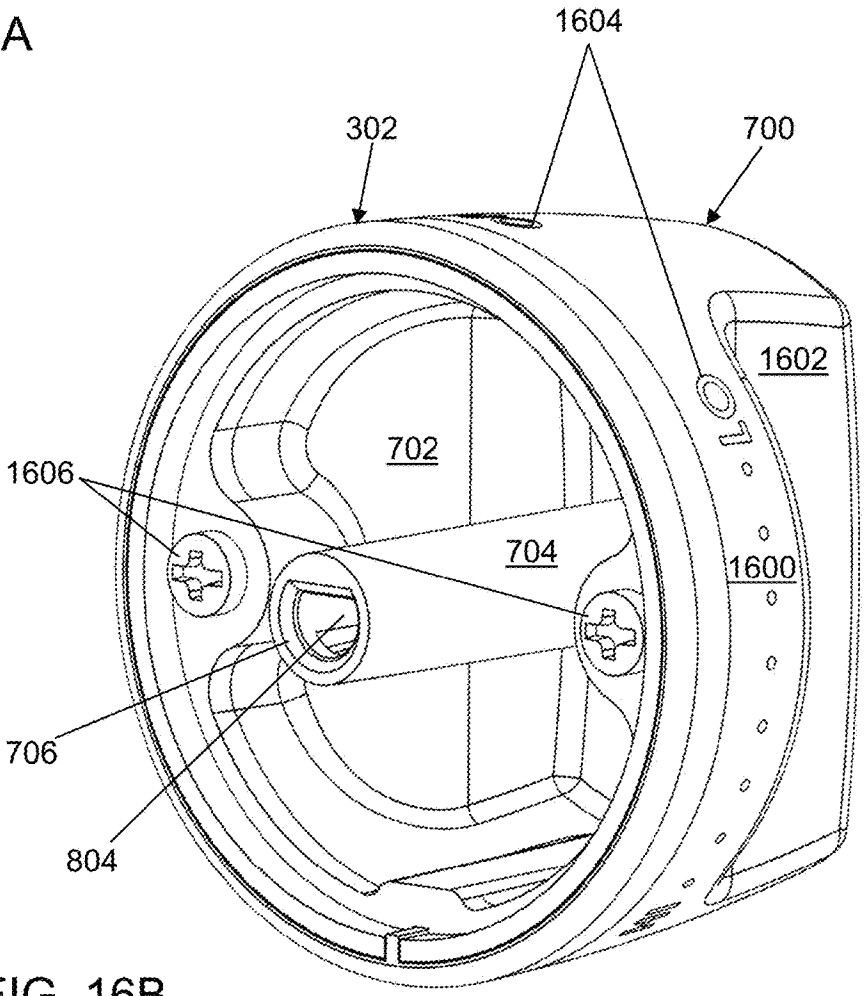
FIG. 16B depicts a back, left perspective view of the knob of FIG. 16A in accordance with an illustrative embodiment.

Referring to FIG. 16A, a front, right perspective view of knob 302 is shown in accordance with an illustrative embodiment. Referring to FIG. 16B, a back, left perspective view of 302 is shown in accordance with an illustrative embodiment. Knob 302 further may include a lettering ring 1600, a handle 1602, lettering 1604, and fasteners 1606. In an illustrative embodiment, knob exterior surface 700 is formed of a metallic material though other materials may be used such as plastic. In an illustrative embodiment, knob interior surface 702 and knob mounting protrusion 704 are formed of a plastic material though other materials may be used. In the illustrative embodiment, knob exterior surface 700 and knob interior surface 702 are formed of distinct components that are mounted to each other using fasteners 1606. In alternative embodiments, knob exterior surface 700 and knob interior surface 702 may be a single component such that no fasteners 1606 are used or alternative fastening methods may be used.

Handle 1602 extends from a portion of lettering ring 1600 away from front housing wall 112 when knob 302 is mounted to front housing wall 112. Handle 1602 extends approximately perpendicularly from top surface portions of lettering ring 1600 and extends continuously from side surface portions of lettering ring 1600 in the illustrative embodiment. A size and a shape of handle 1602 is selected to provide a comfortable grasping location for the user to rotate knob 302 while providing a positive aesthetic appearance. Lettering 1604 is formed on a side surface of lettering ring 1600 to indicate a flame setting. In the illustrative embodiment, the lettering includes "OFF HI . . . LO SIM ▷ HI . . . LO" though symbols may be used in alternative embodiments. The lettering OFF is positioned upwards when the burner is off. Turning the knob counter clockwise controls a first burner HI . . . LO. Continued rotation controls a second burner SIM▷ HI . . . LO. Numerical setting values may be used in alternative embodiments. The lettering may be provided using various methods including etching, molding, painting, etc. In an illustrative embodiment, only one of first burner and second burner is lit at a time. Thus, continued rotation to turn the second burner on turns off the first burner. Knob 302 may have a different shape than that illustrated.

Figure 17B:
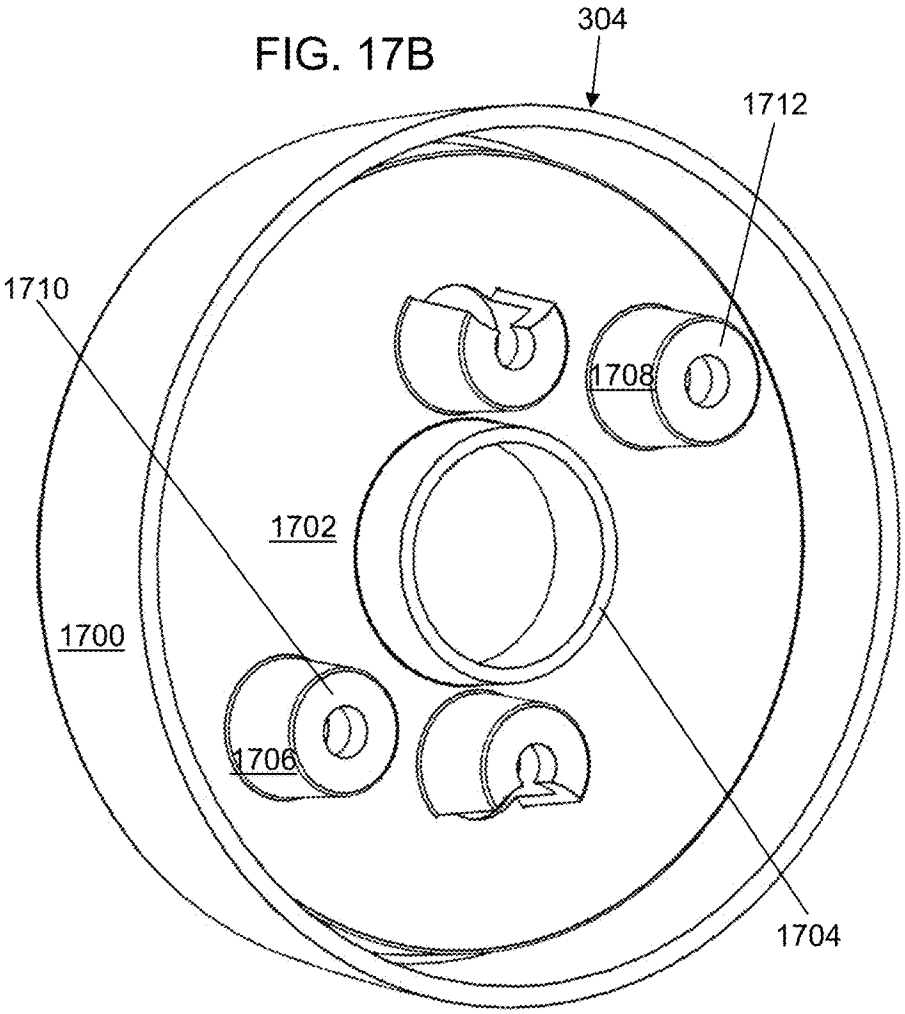
FIG. 17B depicts a back, right perspective view of the bezel of FIG. 17A in accordance with an illustrative embodiment.
Figure 17A:
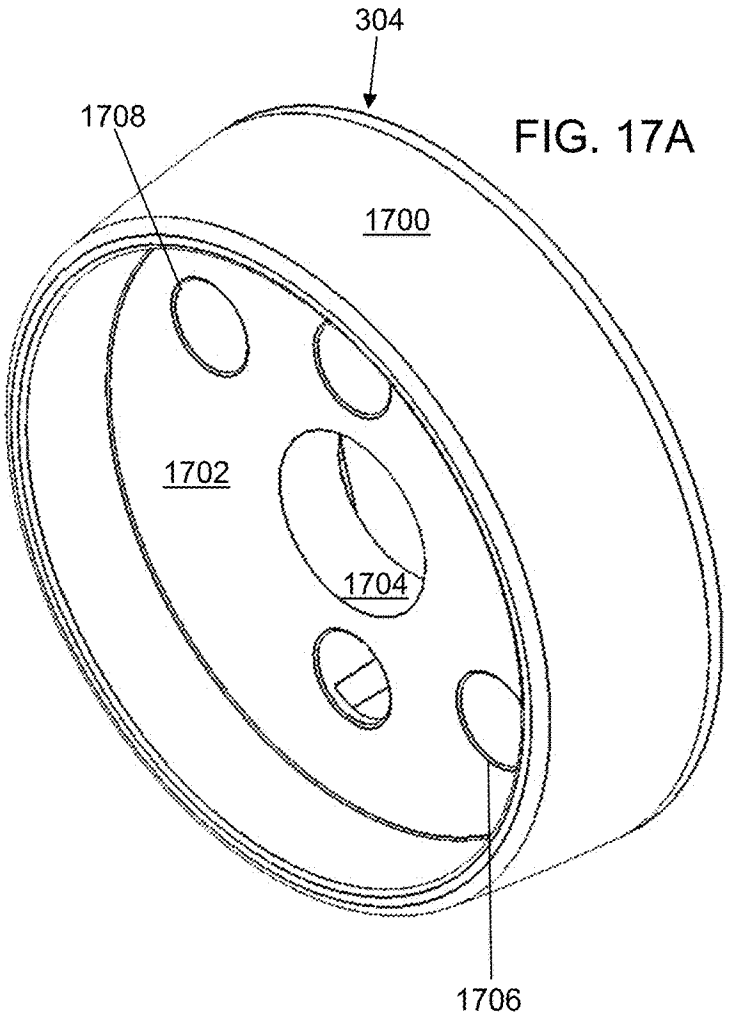
FIG. 17A depicts a front, right perspective view of a bezel of the knob assembly of FIG. 3 in accordance with an illustrative embodiment.

Referring to FIG. 17A, a front, right perspective view of bezel 304 is shown in accordance with an illustrative embodiment. Referring to FIG. 17B, a back, right perspective view of bezel 304 is shown in accordance with an illustrative embodiment. Bezel 304 may include a bezel sidewall 1700, a bezel mounting wall 1702, second receptacle aperture wall 1704, first bezel fastener head aperture wall 1706, a first bezel fastener shaft aperture wall 1710, second bezel fastener head aperture wall 1708, a second bezel fastener shaft aperture wall 1712. In an illustrative embodiment, bezel sidewall 1700 and bezel mounting wall 1702 are formed of a metallic material though other materials may be used such as plastic. Bezel sidewall 1700 extends approximately perpendicularly away from bezel mounting wall 1702 to form a cavity within which knob 302 can be pressed into bezel 304 to turn on the respective burner. Bezel sidewall 1700 also forms a cavity on an opposite side of bezel mounting wall 1702.

Second receptacle aperture wall 1704 is formed through bezel 304 and defines an aperture sized and shaped to accept at least a portion of receptacle mounting protrusion 802 therein. For example, receptacle mounting protrusion 802 may have a conical shape that narrows further from receptacle base 2000 (shown referring to FIG. 20A) so that receptacle mounting protrusion 802 slides into second receptacle aperture wall 1704 a predetermined distance to provide a snug fit against second receptacle aperture wall 1704.

First bezel fastener head aperture wall 1706 is formed through bezel 304 and defines an aperture sized and shaped to accept a head of first bezel fastener 402. An exterior of first bezel fastener head aperture wall 1706 further may be sized and shaped to fit at least partially within first bezel fastener aperture wall 604 when bezel 304 is mounted to front housing wall 112. For example, first bezel fastener head aperture wall 1706 may have a conical shape that narrows further from bezel mounting wall 1702 so that first bezel fastener head aperture wall 1706 slides into first bezel fastener aperture wall 604 a predetermined distance to provide a snug fit against first bezel fastener aperture wall 604.

Second bezel fastener head aperture wall 1708 is formed through bezel 304 and defines an aperture sized and shaped to accept a head of second bezel fastener 800. An exterior of second bezel fastener head aperture wall 1708 further may be sized and shaped to fit at least partially within second bezel fastener aperture wall 606 when bezel 304 is mounted to front housing wall 112. For example, second bezel fastener head aperture wall 1708 may have a conical shape that narrows further from bezel mounting wall 1702 so that second bezel fastener head aperture wall 1708 slides into second bezel fastener aperture wall 606 a predetermined distance to provide a snug fit against second bezel fastener aperture wall 606.

First bezel fastener shaft aperture wall 1710 is formed across a first end of first bezel fastener head aperture wall 1706 opposite a second end of first bezel fastener head aperture wall 1706 that is formed on bezel mounting wall 1702. First bezel fastener shaft aperture wall 1710 defines an aperture sized and shaped to accept a shaft of first bezel fastener 402.

Second bezel fastener shaft aperture wall 1712 is formed across a first end of second bezel fastener head aperture wall 1708 opposite a second end of second bezel fastener head aperture wall 1708 that is formed on bezel mounting wall 1702. Second bezel fastener shaft aperture wall 1712 defines an aperture sized and shaped to accept a shaft of second bezel fastener 800.

In the illustrative embodiment, first bezel fastener 402 and second bezel fastener 800 are screws that include a shaft and a head as understood by a person of skill in the art. A portion of the shafts may be threaded. Other types of fasteners and mounting methods than those shown for illustration may be used to mount the components of first knob-valve assembly 206 to each other.

Figure 18B:
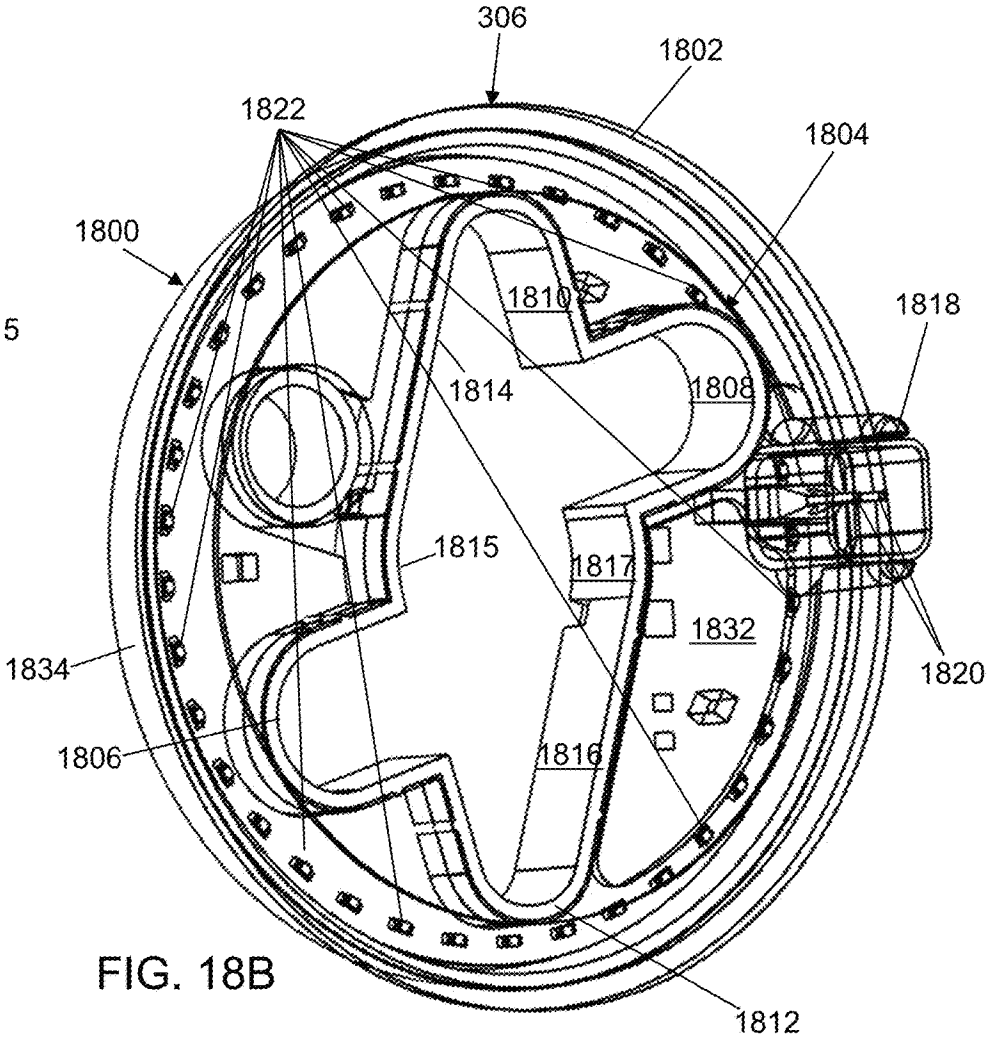
FIG. 18B depicts a back, right perspective view of the light assembly of FIG. 18A in accordance with an illustrative embodiment.
Figure 18A:
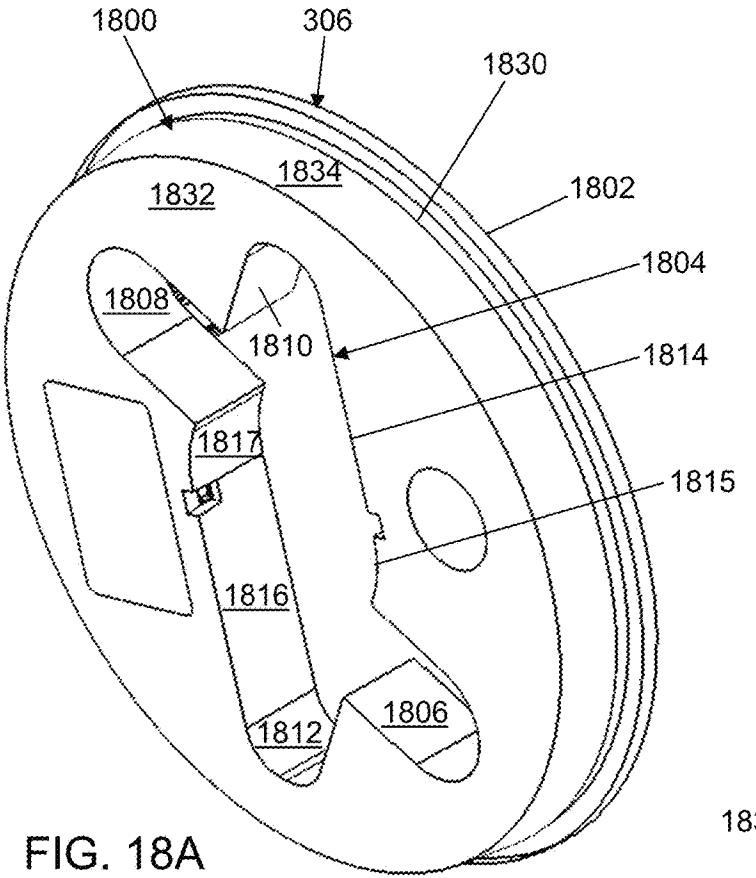
FIG. 18A depicts a front, right perspective view of the light assembly of the knob assembly of FIG. 3 in accordance with an illustrative embodiment.
Figure 18C:
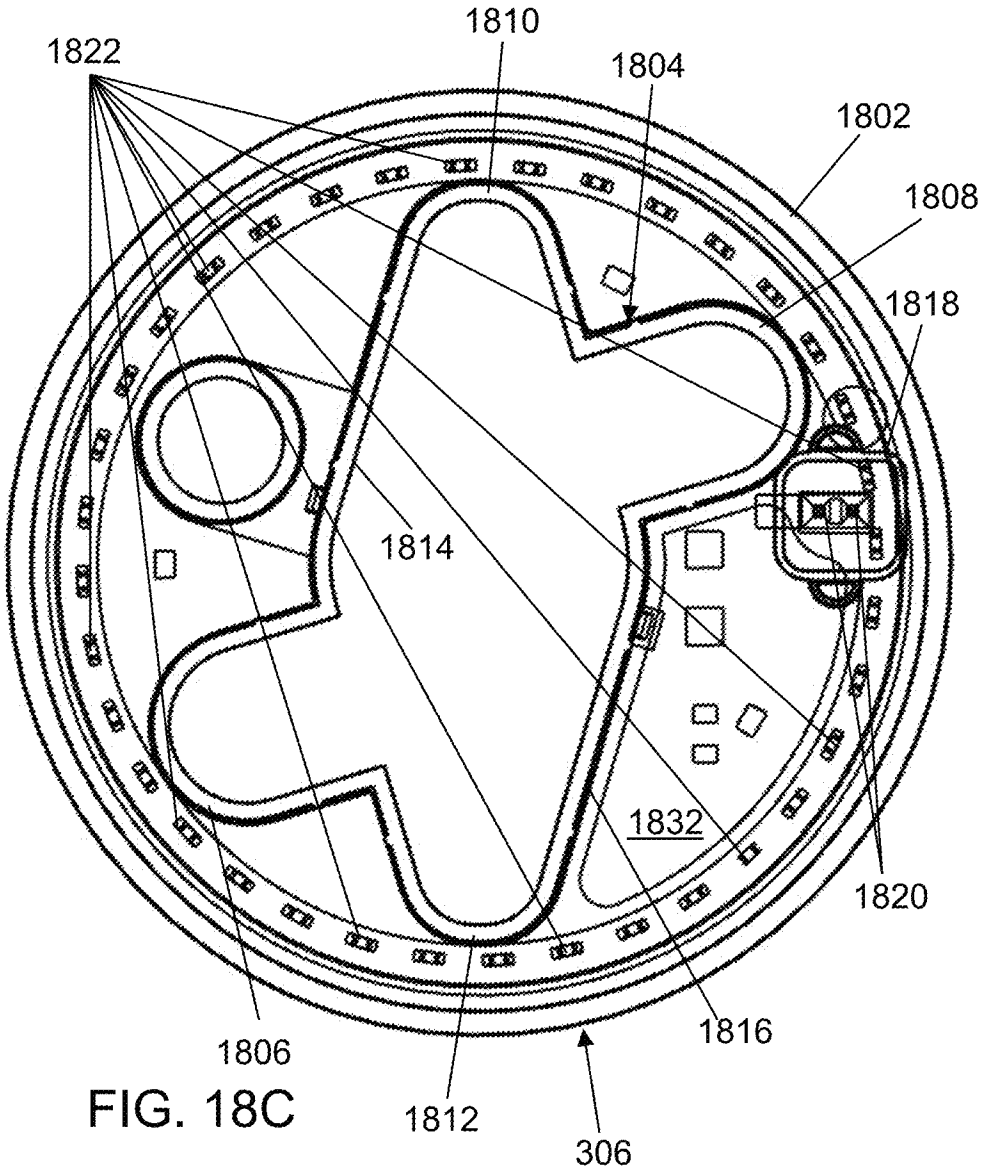
FIG. 18C depicts a back view of the light assembly of FIG. 18A in accordance with an illustrative embodiment.
Figure 18D:
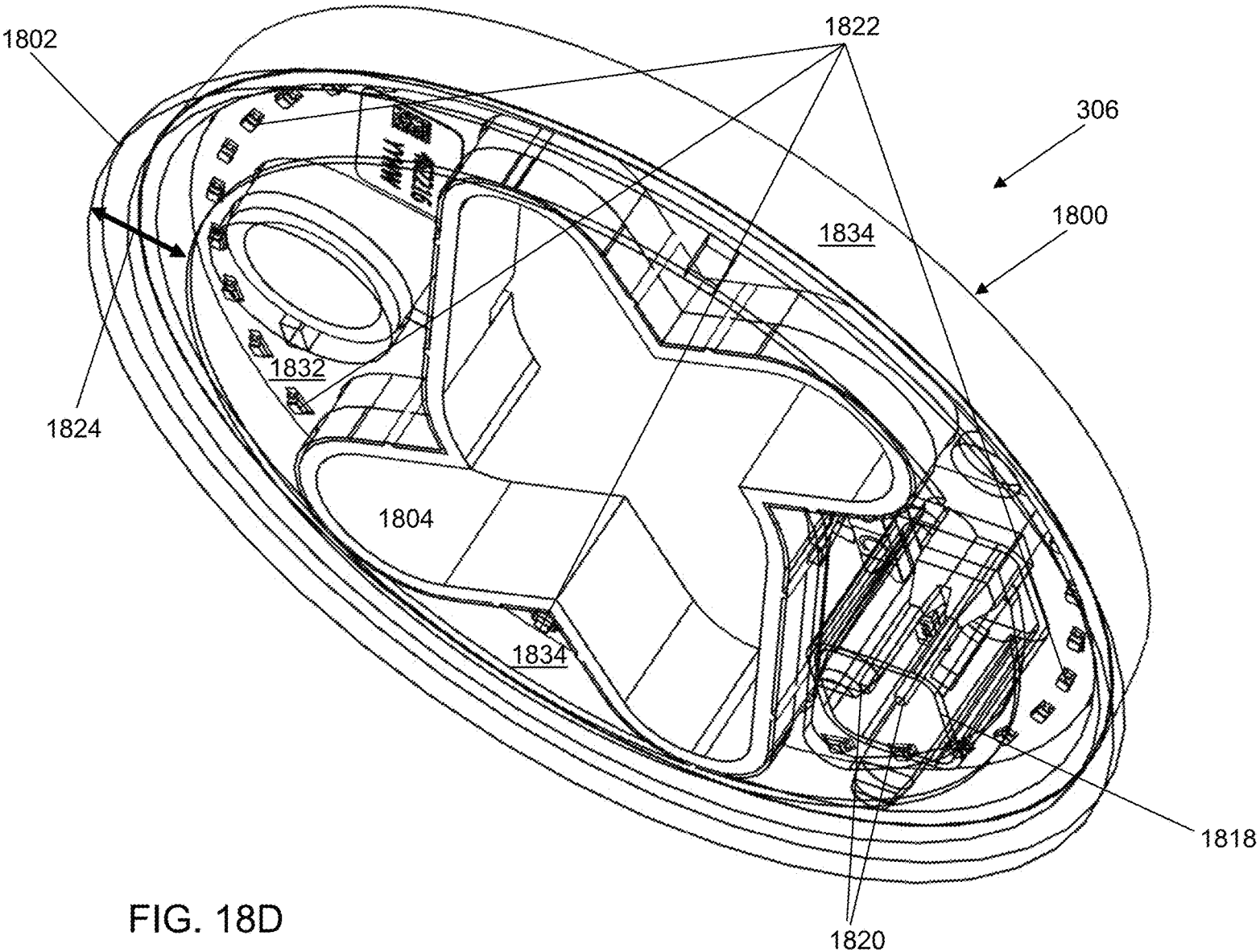
FIG. 18D depicts a back, left perspective view of the light assembly of FIG. 18A in accordance with an illustrative embodiment.
Figure 18E:
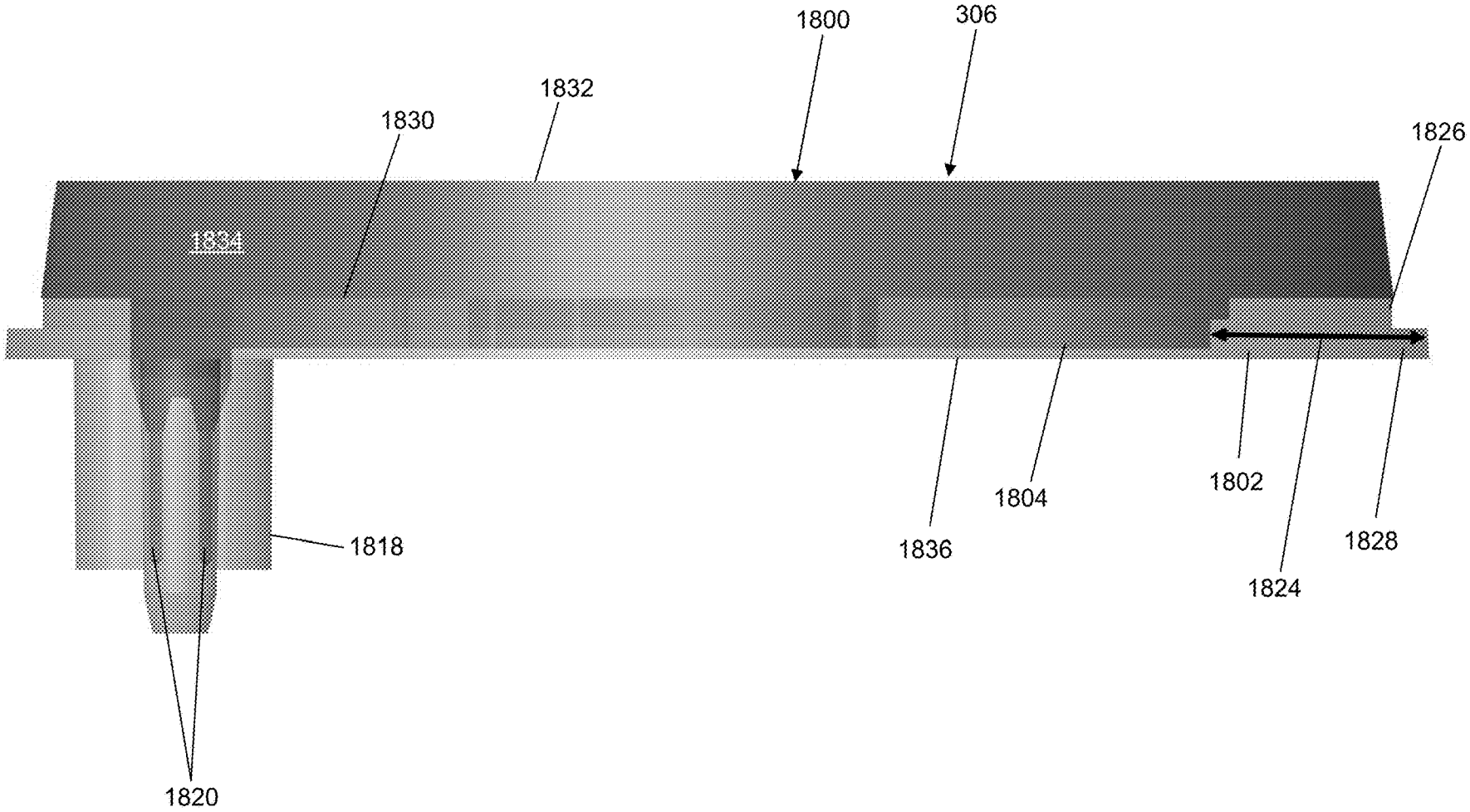
FIG. 18E depicts a side view of the light assembly of FIG. 18A in accordance with an illustrative embodiment.
Figure 19:
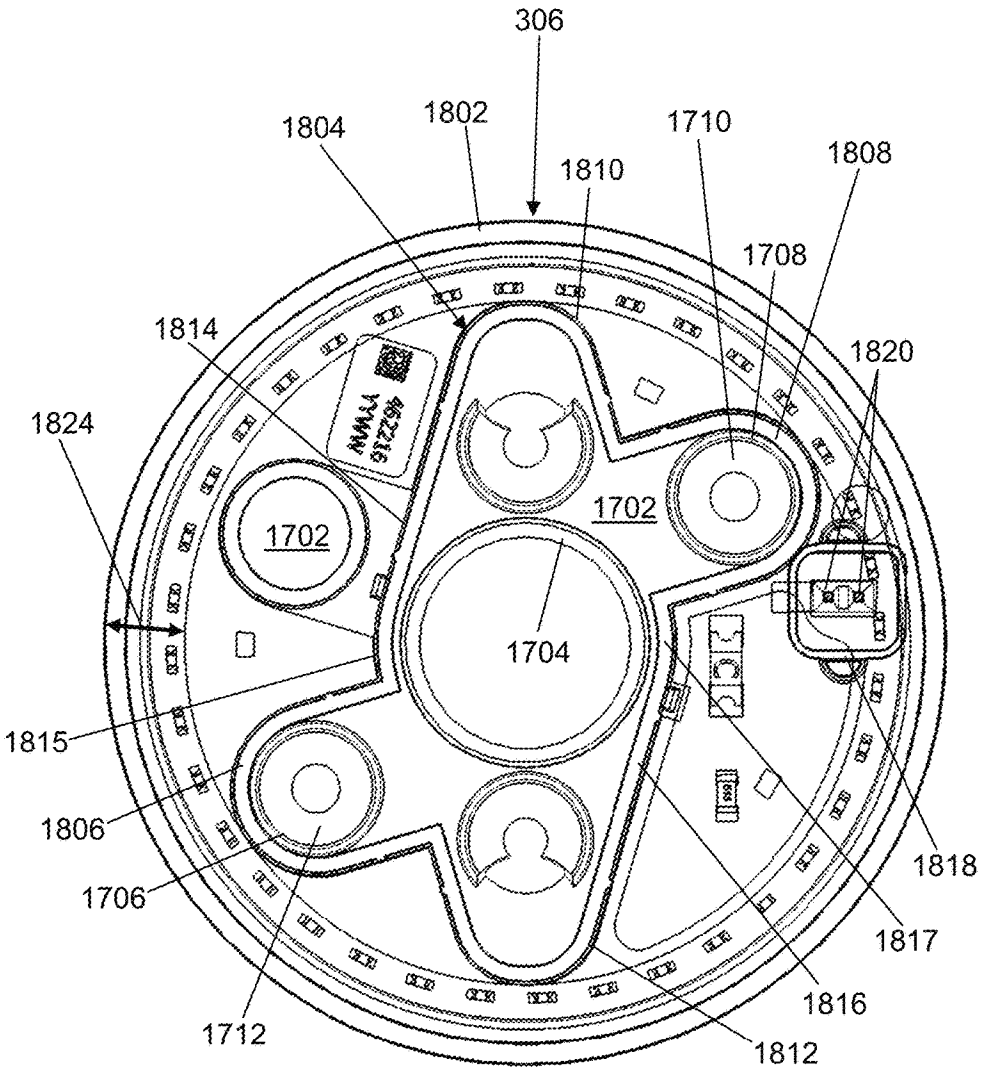
FIG. 19 depicts a back view of the light assembly of FIG. 18A mounted to the bezel of FIG. 17A in accordance with an illustrative embodiment.

Referring to FIG. 18A a front, right perspective view of light assembly 306 is shown in accordance with an illustrative embodiment. Referring to FIG. 18B, a back, right perspective view of light assembly 306 is shown in accordance with an illustrative embodiment. Referring to FIG. 18C, a back view of light assembly 306 is shown in accordance with an illustrative embodiment. Referring to FIG. 18D, a back, left perspective view of light assembly 306 is shown in accordance with an illustrative embodiment. Referring to FIG. 18E, a side view of light assembly 306 is shown in accordance with an illustrative embodiment. Referring to FIG. 19, a back view of light assembly 306 mounted to bezel 304 is shown in accordance with an illustrative embodiment.

Light assembly 306 may include a light housing 1800, a light diffuser ring 1802, a mounting aperture wall 1804, first connector housing 1818, light connectors 1820, and a light source 1822. In an illustrative embodiment, light housing 1800 and light diffuser ring 1802 are formed of distinct parts that are mounted to each other using tabs and a friction fit though other mounting methods may be used.

Light housing 1800 may include a top wall 1832 and a sidewall 1834 that extends from an exterior circumferential edge of top wall 1832. Mounting aperture wall 1804 and first connector housing 1818 are mounted to extend from an interior surface of top wall 1832 from which sidewall 1834 extends. Top wall 1832, sidewall 1834, mounting aperture wall 1804, and first connector housing 1818 may be integrally formed together, for example, using a molding process. Light connectors 1820 and light source 1822 are mounted within the interior of light housing 1800 formed by top wall 1832 and sidewall 1834 between sidewall 1834 and mounting aperture wall 1804.

In the illustrative embodiment, light diffuser ring 1802 has a circular shape that extends from a circumferential edge 1830 of light housing 1800 though other shapes may be used. Light diffuser ring 1802 may be formed of a translucent or semi-transparent and reflective material to provide diffused light that indicates whether a respective control knob of the plurality of control knobs 104 is on in terms of controlling operation of the respective burner. In the illustrative embodiment, referring to FIG. 18E, light diffuser ring 1802 extends away from circumferential edge 1830 of light housing 1800 to define a first ring portion 1826 and perpendicularly from first ring portion 1826 to define a second ring portion 1828 so that second ring portion 1828 of light diffuser ring 1802 has a larger exterior radius than light housing 1800. In the illustrative embodiment, a circumference of sidewall 1834 of light housing 1800 fits within bezel sidewall 1700; whereas, a circumference of second ring portion 1828 of light diffuser ring 1802 does not fit within bezel sidewall 1700 so that second ring portion 1828 of light diffuser ring 1802 is visible between front housing wall 112 and bezel 304 when light assembly 306 is mounted to front housing wall 112, but light housing 1800 is not visible.

An exterior surface 1836 of second ring portion 1828 of light diffuser ring 1802 that is opposite circumferential edge 1830 of light housing 1800 mounts flush with the first side of front housing wall 112 on which knob 302 is located. Due to the flush fitting, there is no gap between exterior surface 1836 of light diffuser ring 1802 and the first side of front housing wall 112. When light received from light source 1822 is diffused through light diffuser ring 1802, the light may exhibit a halo effect that may partially reflect from a surface of the first side of front housing wall 112 to further enhance visibility of the light that indicates the respective control knob of the plurality of control knobs 104 is on.

Referring to FIGS. 18D and 18E, second ring portion 1828 of light diffuser ring 1802 has a radial width 1824. Light diffuser ring 1802 may have various radial widths selected to provide a desired diffused light, mount consistently to circumferential edge 1830 of light housing 1800, and not interfere with other elements of light housing 1800 such as mounting aperture wall 1804 and first connector housing 1818. For example, in the illustrative embodiment, a radial width of light diffuser ring 1802 varies around circumferential edge 1830 of light housing 1800 for both first ring portion 1826 and second ring portion 1828.

Light source 1822 is housed within light housing 1800 adjacent light diffuser ring 1802 to generate the light. For example, light source 1822 is mounted to shine the light towards light diffuser ring 1802. For illustration, light source 1822 may be a plurality of light emitting diodes (LEDs), and the light connectors 1820 may be a cathode prong and an anode prong of the plurality of LEDs though other light sources and light connectors may be used in alternative embodiments. The light may be any color including white, red, pink, etc. In the illustrative embodiment, the plurality of LEDs is arranged in a circular pattern proximate a circumferential edge of top wall 1832 of light housing 1800 adjacent side wall 1834 facing into light diffuser ring 1802 so that the illumination is evenly distributed along a length of light diffuser ring 1802 adjacent front housing wall 112. For example, referring to FIGS. 18B and 18D, the plurality of LEDs is mounted to a back surface of top wall 1832 of light housing 1800. The LEDs are equidistant from each other around the back surface of top wall 1832 to provide even light distribution though this is not required. In alternative embodiments, the LEDs may be arranged to form an arc over a preselected number of degrees instead of a complete ring. Various numbers and sizes of LED may be selected to provide a desired amount of light, a desired power usage, fit within light housing 1800 adjacent light diffuser ring 1802, etc.

In the illustrative embodiment, first connector housing 1818 has a similar shape to second connector housing 2010 though first connector housing 1818 is smaller than second connector housing 2010 so that first connector housing 1818 fits within second connector housing 2010 when light connectors 1820 are inserted into light connector aperture walls 2114 (shown referring to FIG. 21A) of light socket 900 housed within second connector housing 2010. In an alternative embodiment, second connector housing 2010 is smaller than first connector housing 1818 so that second connector housing 2010 fits within first connector housing 1818 when light connectors 1820 are inserted into light connector aperture walls 2114. First connector housing 1818 mating with second connector housing 2010 assists in aligning light connectors 1820 with light connector aperture walls 2114 of light socket 900.

In the illustrative embodiment, light connectors 1820 are prongs that extend from light housing 1800 towards light connector aperture walls 2114 of light socket 900 when light assembly 306 is mounted to receptacle 400. Light connectors 1820 are recessed from an outer edge of first connector housing 1818 so that light connectors 1820 do not extend beyond the outer edge. First connector housing 1818 surrounds the recessed light connectors 1820 to prevent damage to light connectors 1820, to provide ease in aligning light connectors 1820 with light socket 900, and to provide electrical isolation of light connectors 1820. Light connectors 1820 are formed at least partially of an electrically conductive material and are electrically connected to light source 1822 (not shown) to provide power to light source 1822 received through them.

Mounting aperture wall 1804 extends from an interior surface of top wall 1832 and forms an aperture in top wall 1832. Mounting aperture wall 1804 may include a first fastener support wall portion 1806, a second fastener support wall portion 1808, a first cupped support wall portion 1810, a second cupped support wall portion 1812, a first support wall portion 1814, a third cupped support wall portion 1815, a second support wall portion 1816, and a fourth cupped support wall portion 1817. For simplicity of description, first fastener support wall portion 1806, second fastener support wall portion 1808, first cupped support wall portion 1810, second cupped support wall portion 1812, first support wall portion 1814, third cupped support wall portion 1815, second support wall portion 1816, and fourth cupped support wall portion 1817 are used to describe a general shape of mounting aperture wall 1804 though they are not distinct elements, but form a single continuous aperture wall in the illustrative embodiment.

First fastener support wall portion 1806 has a "C-shape" and is formed between second cupped support wall portion 1812 and third cupped support wall portion 1815 in a lower right portion of light housing 1800. Second fastener support wall portion 1808 has a "C-shape" and is formed between first cupped support wall portion 1810 and fourth cupped support wall portion 1817 in an upper left portion of light housing 1800. First cupped support wall portion 1810 is arc shaped and formed between second fastener support wall portion 1808 and first support wall portion 1814 in an upper portion of light housing 1800. Second cupped support wall portion 1812 is arc shaped and formed between first fastener support wall portion 1806 and second support wall portion 1816 in a lower portion of light housing 1800. First support wall portion 1814 is linear shaped and formed between first cupped support wall portion 1810 and third cupped support wall portion 1815. Second support wall portion 1816 is linear shaped and formed between second cupped support wall portion 1812 and fourth cupped support wall portion 1817.

Referring to FIG. 19, first fastener support wall portion 1806 is sized and shaped to at least partially accept first bezel fastener head aperture wall 1706 therein as shown. Similarly, second fastener support wall portion 1808 is sized and shaped to at least partially accept second bezel fastener head aperture wall 1708 therein. Third cupped support wall portion 1815 and fourth cupped support wall portion 1817 are sized and shaped to at least partially accept second receptacle aperture wall 1704 therein so that mounting aperture wall 1804 provides a friction fit against light diffuser ring 1802 at a plurality of points.

Figure 20B:
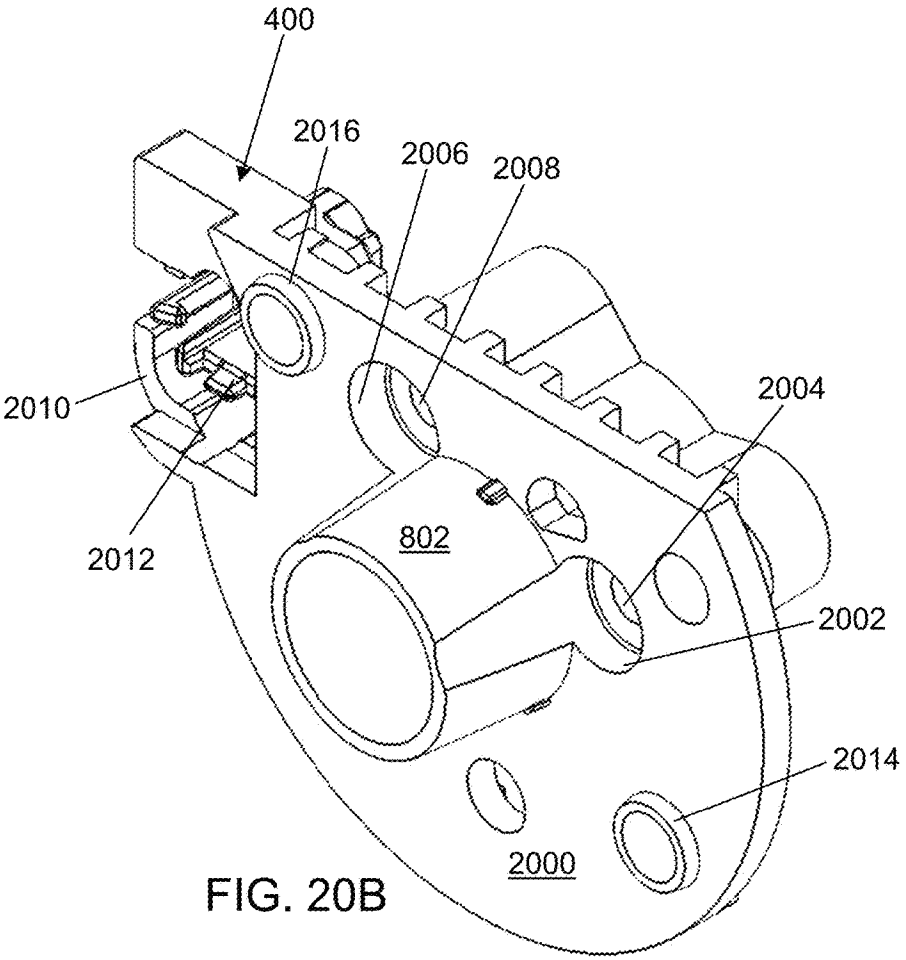
FIG. 20B depicts a front, right perspective view of the receptacle of FIG. 20A in accordance with an illustrative embodiment.
Figure 20A:
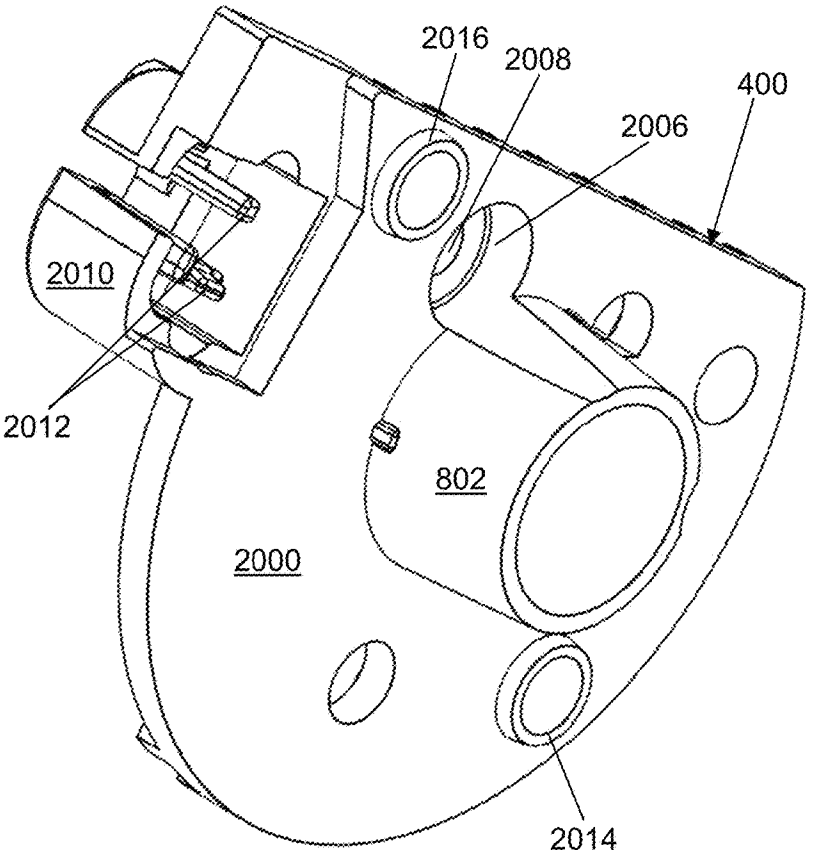
FIG. 20A depicts a front, left perspective view of the receptacle of the knob assembly of FIG. 3 in accordance with an illustrative embodiment.
Figure 20C:
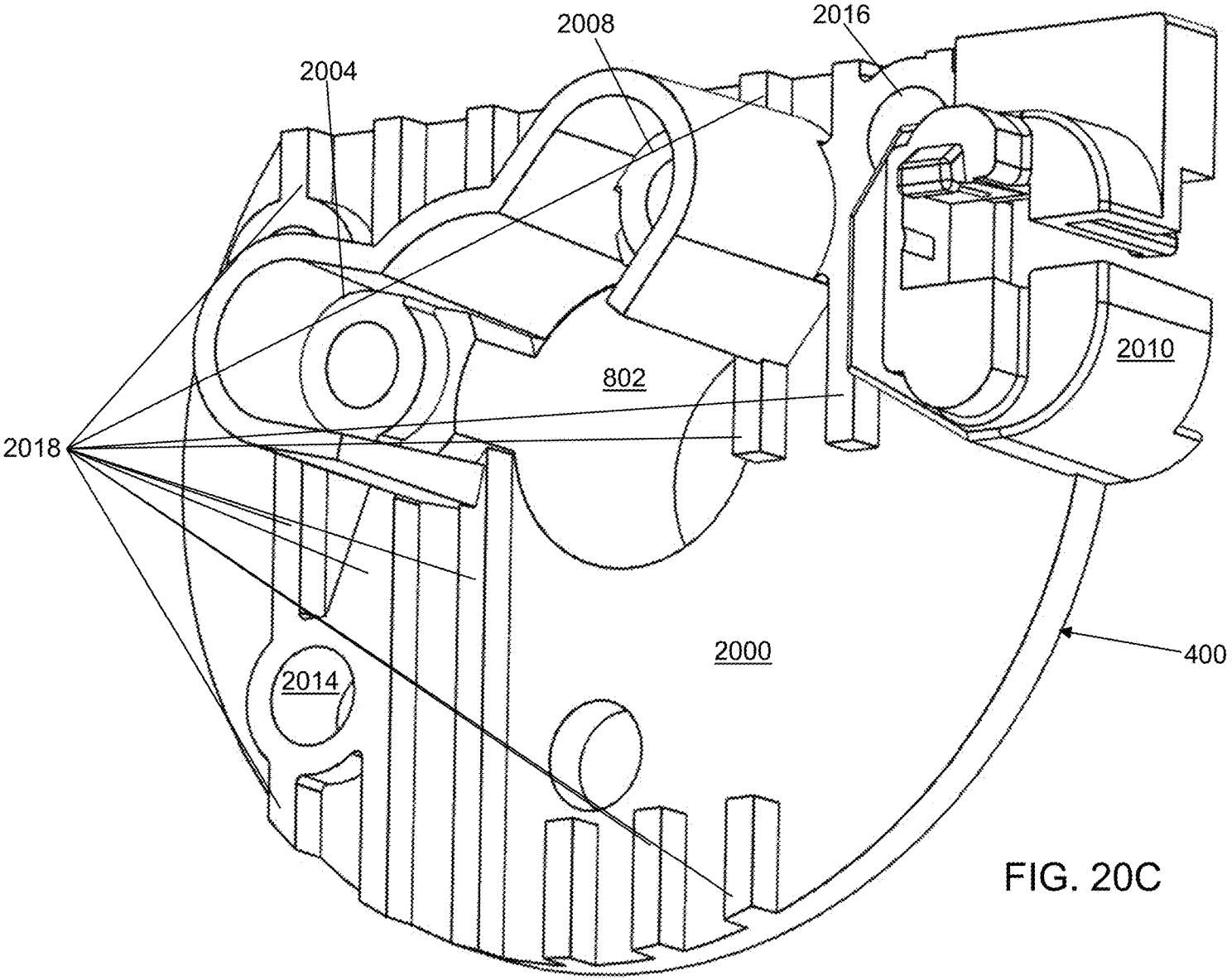
FIG. 20C depicts a back, left view of the receptacle of FIG. 20A in accordance with an illustrative embodiment.

Referring to FIG. 20A, a front, left perspective view of receptacle 400 is shown in accordance with an illustrative embodiment. Referring to FIG. 20B, a front, right perspective view of receptacle 400 is shown in accordance with an illustrative embodiment. Referring to FIG. 20C, a back, left view of receptacle 400 is shown in accordance with an illustrative embodiment. Receptacle 400 may include a receptacle base 2000, a first receptacle fastener head aperture wall 2002, a first receptacle fastener shaft aperture wall 2004, a second receptacle fastener head aperture wall 2006, a second receptacle fastener shaft aperture wall 2008, a second connector housing 2010, connector support walls 2012, a first fastener shaft aperture wall 2014, and a second fastener shaft aperture wall 2016. A plurality of ribs 2018 may be formed on a back surface of receptacle base 2000 to provide additional rigidity while using less material. In an illustrative embodiment, receptacle 400 is formed of a plastic material, for example using a molding process.

First receptacle fastener head aperture wall 2002 is formed through receptacle base 2000 and defines an aperture sized and shaped to accept a shaft and a head of first receptacle fastener 1002. First receptacle fastener shaft aperture wall 2004 is formed through receptacle base 2000 centered within first receptacle fastener head aperture wall 2002 and defines an aperture sized and shaped to accept the shaft but not the head of first receptacle fastener 1002. The shaft of first receptacle fastener 1002 is threaded into valve first fastener wall 1306 to mount receptacle 400 to the valve 212.

Second receptacle fastener head aperture wall 2006 is formed through receptacle base 2000 and defines an aperture sized and shaped to accept a shaft and a head of second receptacle fastener 1004. Second receptacle fastener shaft aperture wall 2008 is formed through receptacle base 2000 centered within second receptacle fastener head aperture wall 2006 and defines an aperture sized and shaped to accept the shaft but not the head of second receptacle fastener 1004. The shaft of second receptacle fastener 1004 is threaded into valve second fastener wall 1308 to mount receptacle 400 to the valve 212.

In the illustrative embodiment, first receptacle fastener 1002 and second receptacle fastener 1004 are screws that include a shaft and a head as understood by a person of skill in the art tough other fastening methods may be used in alternative embodiments. A portion of the shafts may be threaded.

Connector support walls 2012 are formed in second connector housing 2010. Connector support walls 2012 and second connector housing 2010 are sized and shaped to hold light socket 900 in place within second connector housing 2010 so that light connectors 1820 can be inserted into light socket 900.

First fastener shaft aperture wall 2014 extends outward from both sides of receptacle base 2000 and is sized and shaped to accept the shaft of first bezel fastener 402 to mount bezel 304 to receptacle 400. Second fastener shaft aperture wall 2016 extends outward from both sides of receptacle base 2000 and is sized and shaped to accept the shaft of second bezel fastener 800 to mount bezel 304 to receptacle 400.

Figure 21A:
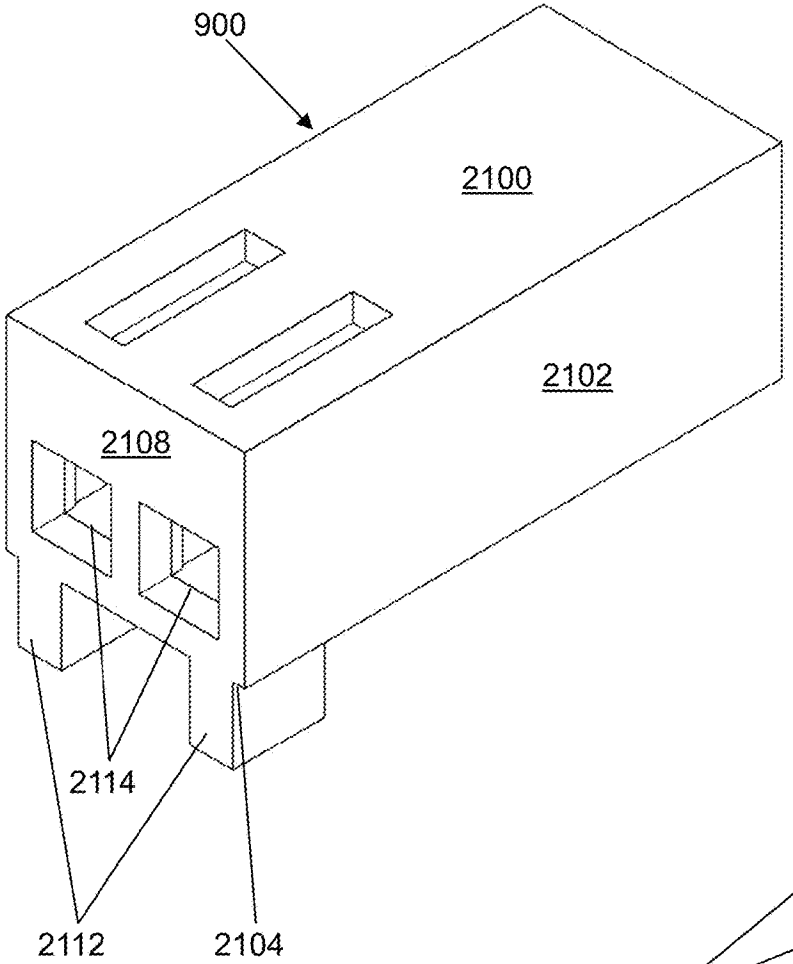
FIG. 21A depicts a front, right perspective view of a light socket of the knob assembly of FIG. 3 in accordance with an illustrative embodiment.
Figure 21B:
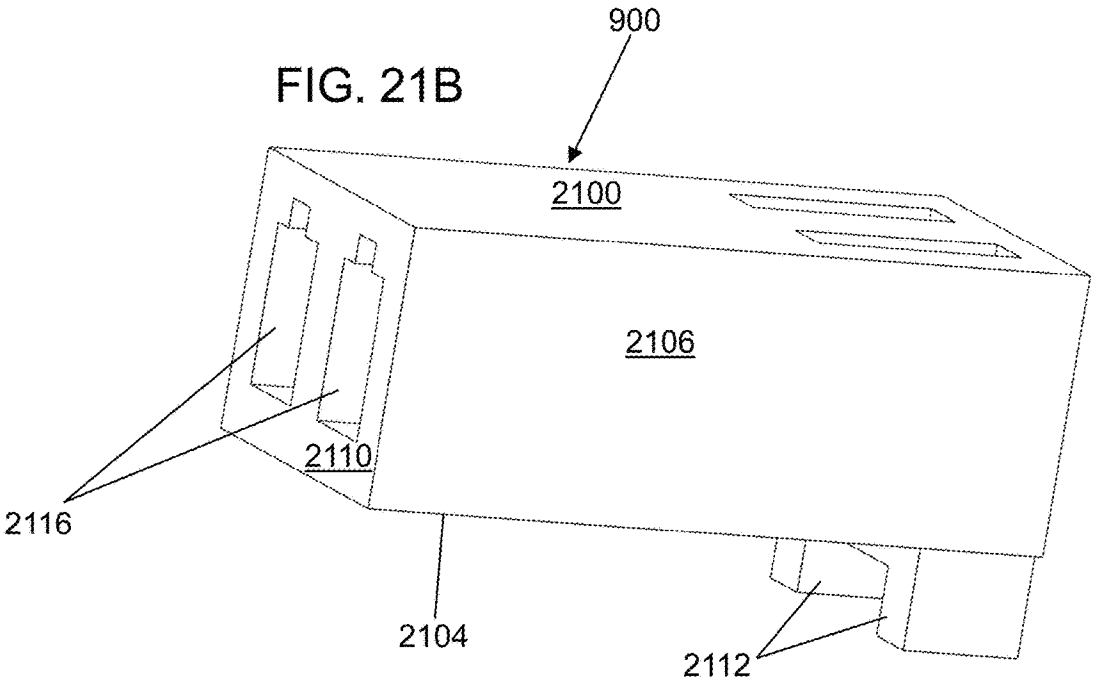
FIG. 21B depicts a back, left perspective view of the light socket of FIG. 21A in accordance with an illustrative embodiment.

Referring to FIG. 21A, a front, right perspective view of light socket 900 is shown in accordance with an illustrative embodiment. Referring to FIG. 21B, a back, left perspective view of light socket 900 is shown in accordance with an illustrative embodiment. Light socket 900 may include a top wall 2100, a right sidewall 2102, a bottom wall 2104, a left sidewall 2106, a front wall 2108, a back wall 2110, alignment feet 2112, light connector aperture walls 2114, and electrical connector aperture walls 2116. Top wall 2100, right sidewall 2102, bottom wall 2104, left sidewall 2106, front wall 2108, and back wall 2110 form a housing within which electricity is transferred from a light power connector (not shown) to light connectors 1820. Alignment feet 2112 extend downward from bottom wall 2104 and may be used to mount and to hold light socket 900 within second connector housing 2010 and on connector support walls 2012. Light connector aperture walls 2114 are formed in front wall 2108 and are sized and shaped to define apertures within which light connectors 1820 are inserted. Electrical connector aperture walls 2116 are formed in back wall 2110 and are sized and shaped to define apertures within which the light power connector is inserted. Light connector aperture walls 2114 and electrical connector aperture walls 2116 or a space between light connector aperture walls 2114 and electrical connector aperture walls 2116 may include a conductivity material applied to transfer power received from the light power connector inserted within electrical connector aperture walls 2116 to light connectors 1820 inserted within light connector aperture walls 2114. In the illustrative embodiment, light socket 900 includes light connector aperture walls 2114 and light connectors 1820 extend from light assembly 306 for insertion into light connector aperture walls 2114. In an alternative embodiment, light connectors 1820 may extend from light socket for insertion in light connector aperture walls 2114 formed on light housing 1800.

Figure 22:
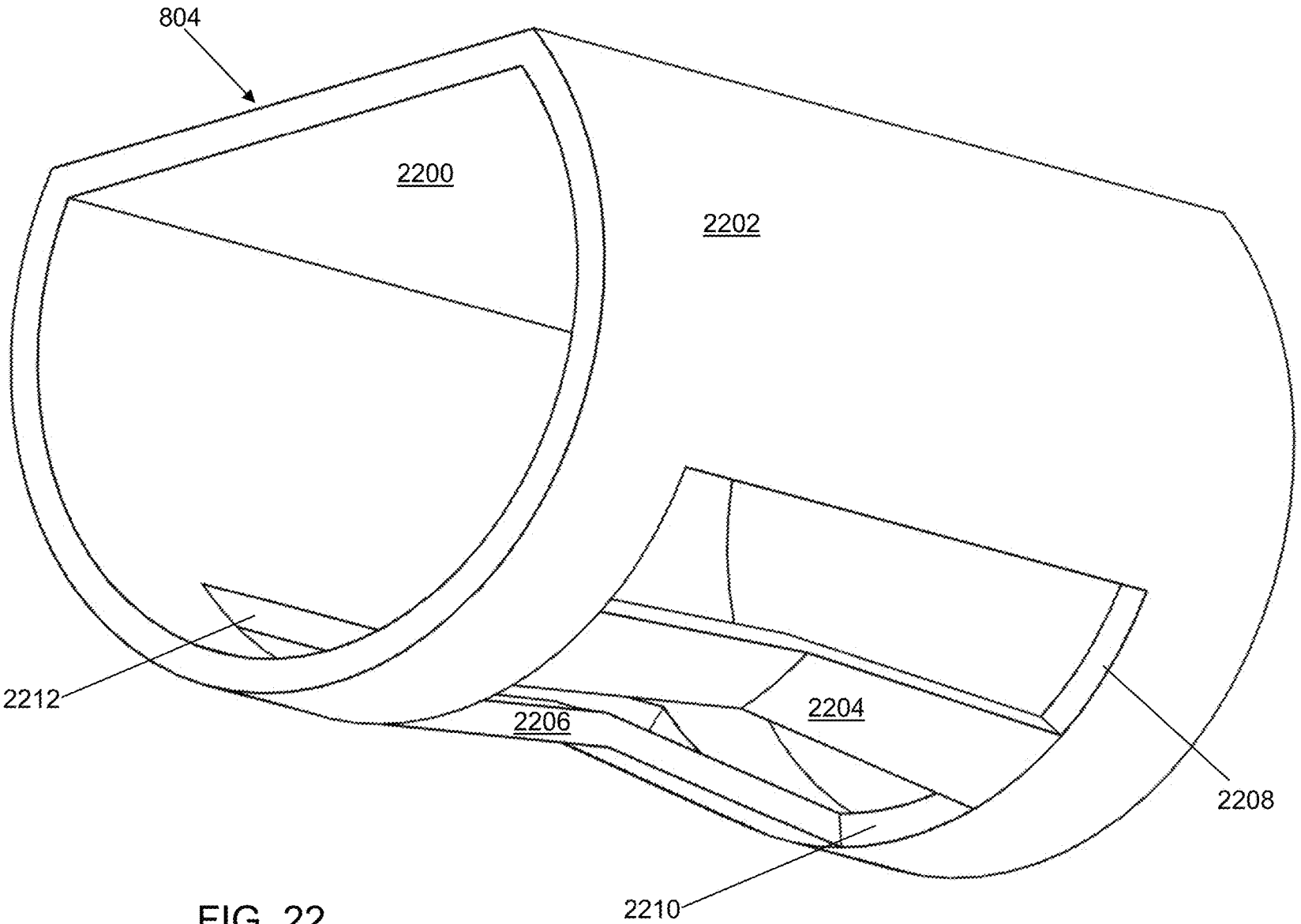
FIG. 22 depicts a back, left perspective view of a knob spring of the knob assembly of FIG. 3 in accordance with an illustrative embodiment.

Referring to FIG. 22, a back, left perspective view of knob spring 804 is shown in accordance with an illustrative embodiment. Knob spring 804 may include a top wall 2200, an arced wall 2202, a first spring wall 2204, a second spring wall 2206, a first spring aperture wall 2208, a second spring aperture wall 2210, and a third spring aperture wall 2212. Top wall 2200 and arced wall 2202 have a similar shape to tip mounting portion 1314 though larger so that knob spring 804 fits over and slides along tip mounting portion 1314 of valve control rod 708. Top wall 2200 and arced wall 2202 also have a similar shape to knob mounting aperture wall 706 though smaller so that knob spring 804 fits within and slides within knob mounting aperture wall 706 of knob mounting protrusion 704.

First spring wall 2204 and second spring wall 2206 are formed in arced wall 2202 on either side of a center of arced wall 2202 relative to a circumferential edge of arced wall 2202. First spring aperture wall 2208 is formed in arced wall 2202 bordered on three sides by arced wall 2202 and on a fourth side by first spring wall 2204. Third spring aperture wall 2212 is formed in arced wall 2202 bordered on three sides by arced wall 2202 and on a fourth side by second spring wall 2206. Second spring aperture wall 2210 is formed in arced wall 2202 bordered on two sides by arced wall 2202, on a third side by first spring wall 2204, and on a fourth side by second spring wall 2206. First spring wall 2204 and second spring wall 2206 can bend near an axial center to provide a return force so that knob spring 804 returns knob 302 to a resting position after the user presses knob 302 into bezel 304 to light the igniter.

First knob-valve assembly 206 is assembled by inserting first receptacle fastener 1002 into first receptacle fastener head aperture wall 2002, first receptacle fastener shaft aperture wall 2004, and valve first fastener wall 1306 to mount receptacle 400 to valve 212. Second receptacle fastener 1004 is also inserted in second receptacle fastener head aperture wall 2006, second receptacle fastener shaft aperture wall 2008, and valve second fastener wall 1308. Light socket 900 is inserted in second connector housing 2010 and mounted to connector support walls 2012. Receptacle mounting protrusion 802 is inserted into receptacle aperture wall 602. Valve 212 is mounted to cooktop 100. The light power connector is inserted into electrical connector aperture walls 2116. Light assembly 306 is slid onto bezel 304, first connector housing 1818 is slid into light connector aperture wall 600 and second connector housing 2010, and light connectors 1820 are slid into light connector aperture walls 2114. Bezel 304 is mounted to light assembly 306 by sliding second receptacle aperture wall 1704 onto receptacle mounting protrusion 802, sliding first bezel fastener head aperture wall 1706 into first bezel fastener aperture wall 604, and sliding second bezel fastener head aperture wall 1708 into second bezel fastener aperture wall 606. First bezel fastener 402 is inserted into first bezel fastener head aperture wall 1706, first bezel fastener shaft aperture wall 1710, and first fastener shaft aperture wall 2014 to mount bezel 304 to receptacle 400. Second bezel fastener 800 is inserted into second bezel fastener head aperture wall 1708, second bezel fastener shaft aperture wall 1712, and second fastener shaft aperture wall 2016 to further mount bezel 304 to receptacle 400. Knob 302 is mounted to knob control rod 708 by sliding knob mounting aperture wall 706 over knob control rod 708. The assembly steps may be performed in orders other than that described.

As used herein, the term "mount" includes join, unite, connect, couple, associate, insert, hang, hold, affix, attach, fasten, bind, paste, secure, hinge, bolt, screw, rivet, solder, weld, glue, form over, form in, layer, mold, rest on, rest against, abut, and other like terms. The phrases "mounted on", "mounted to", and equivalent phrases indicate any interior or exterior portion of the element referenced. These phrases also encompass direct mounting (in which the referenced elements are in direct contact) and indirect mounting (in which the referenced elements are not in direct contact, but are connected through an intermediate element) unless specified otherwise. Elements referenced as mounted to each other herein may further be integrally formed together, for example, using a molding or thermoforming process as understood by a person of skill in the art. As a result, elements described herein as being mounted to each other need not be discrete structural elements unless specified otherwise. The elements may be mounted permanently, removably, or releasably unless specified otherwise.

Use of directional terms, such as top, bottom, right, left, front, back, upper, lower, horizontal, vertical, behind, etc. are merely intended to facilitate reference to the various surfaces of the described structures relative to the orientations introduced in the drawings and are not intended to be limiting in any manner unless otherwise indicated.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A knob assembly comprising:

a knob configured to mount to a knob control rod, wherein the knob control rod is configured to rotate with the knob when the knob is rotated to control operation of a device;

a light assembly mounted to the knob, the light assembly comprising a light housing including a first aperture wall defining a first aperture through which the knob control rod extends when the light assembly is mounted between the knob and the device;

a light diffuser mounted to the light housing;

a light source mounted to the light housing, wherein light from the light source is transmitted through the light diffuser when the knob is rotated to control operation of the device; and a light connector prong mounted to the light housing and electrically connected to the light source to provide power to the light source when the knob is rotated;

a light socket comprising a socket housing;

a light connector aperture wall formed in a first wall of the socket housing, wherein the light connector prong is mounted within the light connector aperture wall when the light assembly is mounted to the light socket;

an electrical connector aperture wall formed in a second wall of the socket housing, wherein a power connector prong connectable to a power source is mounted within the electrical connector aperture wall when the light socket is electrically connected to the device; and an internal conductor mounted within the socket housing and configured to electrically connect the light connector prong to the power connector prong; and a receptacle mounted between the light assembly and the device, the receptacle comprising a receptacle base including a second aperture wall defining a second aperture through which the knob control rod extends when the receptacle is mounted to the device; and a connector housing mounted to the receptacle base and configured to house the light socket;

wherein the receptacle base is configured to mount adjacent a first face of a first wall of the device when the knob assembly is mounted to the device, wherein the light diffuser is configured to mount adjacent a second face of the first wall of the device when the knob assembly is mounted to the device, wherein the second face is on an opposite side of the first wall relative to the first face, wherein the light connector prong is inserted into the light connector aperture wall through the first wall when the knob assembly is mounted to the device.

2. The knob assembly of claim 1, further comprising the knob control rod.

3. The knob assembly of claim 2, wherein the knob comprises a knob mounting aperture wall defining a hole sized and shaped to capture a tip of the knob control rod.

4. The knob assembly of claim 1, wherein the device is selected from the group consisting of a gas cooktop, a gas oven, a gas stove, an electric cooktop, an electric oven, and an electric stove.

5. The knob assembly of claim 1, wherein the light diffuser includes a material through which the light radiates when received from the light source.

6. The knob assembly of claim 1, wherein the light source comprises a plurality of light emitting diodes mounted to an interior surface of the light housing.

7. The knob assembly of claim 6, wherein the plurality of light emitting diodes form a ring around a circumferential edge of the light housing.

8. The knob assembly of claim 7, wherein the plurality of light emitting diodes are equidistant from each other.

9. The knob assembly of claim 1, wherein the light source is mounted between the knob and the light diffuser.

10. The knob assembly of claim 1, wherein the light diffuser contacts the second face of the first wall of the device when the knob assembly is mounted to the device.

11. The knob assembly of claim 1, wherein the receptacle base contacts the first face of the first wall of the device when the knob assembly is mounted to the device.

12. The knob assembly of claim 1, wherein the light assembly further comprises a second light connector prong mounted to the light housing and electrically connected to the light source to provide power to the light source when the knob is rotated, wherein the light socket further comprises a second light connector aperture wall formed in the first wall of the socket housing, wherein the second light connector prong is mounted within the second light connector aperture wall when the light assembly is mounted to the light socket.

13. The knob assembly of claim 1, wherein the light assembly further comprises a second connector housing mounted to the light housing to at least partially surround the light connector prong, wherein the second connector housing mates with the connector housing.

14. The knob assembly of claim 13, wherein the second connector housing mates with the connector housing such that the second connector housing is through the first wall of the device when the knob assembly is mounted to the device.

15. The knob assembly of claim 1, further comprising a fastener, wherein the receptacle further comprises a fastener wall formed through the receptacle base, wherein a fastener extends through the fastener wall and into the device to mount the receptacle to the device when the knob assembly is mounted to the device.

16. The knob assembly of claim 15, further comprising a second fastener, wherein the light assembly further comprises a second fastener wall formed through a wall of the light housing, wherein a second fastener extends through the second fastener wall, through the first wall of the device, and into the receptacle to mount the light assembly to the receptacle when the knob assembly is mounted to the device.

17. The knob assembly of claim 16, further comprising a bezel mounted between the knob and the light assembly, wherein the second fastener further extends through a third fastener aperture wall formed through a wall of the bezel when the knob assembly is mounted to the device.

18. The knob assembly of claim 1, further comprising a protrusion wall mounted to the receptacle base that extends through the first aperture wall of the light housing and through the first wall of the device when the knob assembly is mounted to the device.

19. A device comprising:

a housing comprising one or more walls;

a switch configured to control operation of a component of the device;

a knob control rod connected to the switch to control operation of the switch; and a knob assembly mounted to a first wall of the one or more walls of the housing, the knob assembly comprising a knob configured to mount to the knob control rod, wherein the knob control rod is configured to rotate with the knob when the knob is rotated to turn on the component of the device;

a light assembly mounted to the knob, the light assembly comprising a light housing including a first aperture wall defining a first aperture through which the knob control rod extends;

a light diffuser mounted to the light housing;

a light source mounted to the light housing, wherein light from the light source is transmitted through the light diffuser when the knob is rotated to turn on the component of the device; and a light connector prong mounted to the light housing and electrically connected to the light source to provide power to the light source when the knob is rotated;

a light socket comprising a socket housing;

a light connector aperture wall formed in a first wall of the socket housing, wherein the light connector prong is mounted within the light connector aperture wall;

an electrical connector aperture wall formed in a second wall of the socket housing, wherein a power connector prong connectable to a power source is mounted within the electrical connector aperture wall when the light socket is electrically connected to the device; and an internal conductor mounted within the socket housing and configured to electrically connect the light connector prong to the power connector prong; and a receptacle mounted between the light assembly and the switch, the receptacle comprising a receptacle base including a second aperture wall defining a second aperture through which the knob control rod extends; and a connector housing mounted to the receptacle base and configured to house the light socket;

wherein the receptacle base is mounted adjacent a first face of the first wall of the device, wherein the light diffuser is mounted adjacent a second face of the first wall of the device, wherein the second face is on an opposite side of the first wall relative to the first face, wherein the light connector prong is inserted into the light connector aperture wall through the first wall.

20. A gas cooktop comprising:

a housing comprising one or more walls;

a grate mounted to the housing, the grate forming a horizontal support surface for a cooking receptacle;

a burner mounted below the grate;

a valve configured to control operation of the burner;

a knob control rod mounted to the valve; and a knob assembly mounted to a first wall of the one or more walls of the housing, the knob assembly comprising a knob configured to mount to the knob control rod, wherein the knob control rod is configured to rotate with the knob when the knob is rotated to turn on the burner;

a light assembly mounted to the knob, the light assembly comprising a light housing including a first aperture wall defining a first aperture through which the knob control rod extends;

a light diffuser mounted to the light housing;

a light source mounted to the light housing, wherein light from the light source is transmitted through the light diffuser when the knob is rotated to turn on the burner; and a light connector prong mounted to the light housing and electrically connected to the light source to provide power to the light source when the knob is rotated;

a light socket comprising a socket housing;

a light connector aperture wall formed in a first wall of the socket housing, wherein the light connector prong is mounted within the light connector aperture wall;

an electrical connector aperture wall formed in a second wall of the socket housing, wherein a power connector prong connectable to a power source is mounted within the electrical connector aperture wall when the light socket is electrically connected to the valve; and an internal conductor mounted within the socket housing and configured to electrically connect the light connector prong to the power connector prong; and a receptacle mounted between the light assembly and the valve, the receptacle comprising a receptacle base including a second aperture wall defining a second aperture through which the knob control rod extends; and a connector housing mounted to the receptacle base and configured to house the light socket;

wherein the receptacle base is mounted adjacent a first face of the first wall, wherein the light diffuser is mounted adjacent a second face of the first wall, wherein the second face is on an opposite side of the first wall relative to the first face, wherein the light connector prong is inserted into the light connector aperture wall through the first wall.

* * * * *